US011940261B2

(12) United States Patent
Sullivan

(10) Patent No.: US 11,940,261 B2
(45) Date of Patent: Mar. 26, 2024

(54) BULKHEAD FOR A PERFORATING GUN ASSEMBLY

(71) Applicant: XConnect, LLC, Denver, CO (US)

(72) Inventor: Shelby L. Sullivan, Minot, ND (US)

(73) Assignee: XConnect, LLC, Denver, CO (US)

( * ) Notice: Subject to any disclaimer, the term of this patent is extended or adjusted under 35 U.S.C. 154(b) by 312 days.

(21) Appl. No.: 17/547,053

(22) Filed: Dec. 9, 2021

(65) Prior Publication Data

US 2022/0120547 A1 Apr. 21, 2022

Related U.S. Application Data

(63) Continuation-in-part of application No. 17/175,651, filed on Feb. 13, 2021, now Pat. No. 11,293,737, which is a continuation-in-part of application No. 16/996,692, filed on Aug. 18, 2020, now Pat. No. 11,402,190, which is a continuation-in-part of (Continued)

(51) Int. Cl.

| | |
|---|---|
| ***E21B 43/1185*** | (2006.01) |
| ***E21B 43/117*** | (2006.01) |
| ***F42D 1/02*** | (2006.01) |
| ***F42D 1/045*** | (2006.01) |

(52) U.S. Cl.

CPC ..... *F42D 1/045* (2013.01); *E21B 43/117* (2013.01); *E21B 43/1185* (2013.01); *F42D 1/02* (2013.01)

(58) Field of Classification Search

USPC ..... 89/1.15

See application file for complete search history.

(56) References Cited

U.S. PATENT DOCUMENTS 2,029,490 A 2/1936 Lane
2,062,974 A 12/1936 Lane (Continued)

FOREIGN PATENT DOCUMENTS

CA 2985242 A1 5/2015
WO 2011160099 12/2011

(Continued)

OTHER PUBLICATIONS

First Office Action from the Canadian Intellectual Property Office Issued in related Canadian Application No. 3,143,562; Report Issued: Sep. 13, 2023; 2 pages.

(Continued)

*Primary Examiner* — Reginald S Tillman, Jr.

(74) *Attorney, Agent, or Firm* — Peter L. Brewer; Thrive IP

(57) ABSTRACT

A bulkhead for transmitting detonation signals. The bulkhead is designed for use with a perforating gun assembly. The bulkhead comprises an elongated tubular body having a first end, a second end opposite the first end, and a bore extending from the first end to the second end. The bulkhead also includes a signal pin residing within the bore of the bulkhead. The signal pin also has a first end, and a second end opposite the first end. An electrically conductive wire is connected to the second end of the signal pin at the second end of the bulkhead. The bulkhead also comprises an end piece extending from the second end of the bulkhead. The end piece closely holds the conductive wire in place. Preferably, the end piece is over-molded to securely hold the detonator wire.

8 Claims, 16 Drawing Sheets

Related U.S. Application Data application No. 16/894,512, filed on Jun. 5, 2020, now Pat. No. 11,255,650, application No. 17/547,053, filed on Dec. 9, 2021 is a continuation-in-part of application No. 17/164,531, filed on Feb. 1, 2021, now Pat. No. 11,255,162, which is a continuation-in-part of application No. 16/836,193, filed on Mar. 31, 2020, now Pat. No. 10,914,145, said application No. 16/996,692 is a continuation-in-part of application No. 16/836,193, filed on Mar. 31, 2020, now Pat. No. 10,914,145.

(60) Provisional application No. 62/987,743, filed on Mar. 10, 2020, provisional application No. 62/890,242, filed on Aug. 22, 2019, provisional application No. 62/845,692, filed on May 9, 2019.

(56) References Cited

U.S. PATENT DOCUMENTS

| | | | |
|---|---|---|---|
| 2,264,450 | A | 12/1941 | Mounce |
| 3,173,992 | A | 3/1965 | Boop |
| 3,504,723 | A | 4/1970 | Cushman et al. |
| 3,528,511 | A | 9/1970 | Boop et al. |
| 3,695,368 | A | 10/1972 | Lanmon, II |
| 4,007,796 | A | 2/1977 | Boop |
| 4,100,978 | A | 7/1978 | Boop |
| 4,164,886 | A | 8/1979 | Hallmark |
| 4,266,613 | A | 5/1981 | Boop |
| 4,491,185 | A | 1/1985 | McClure |
| 4,759,291 | A | 7/1988 | Barker et al. |
| 4,790,383 | A | 12/1988 | Savage et al. |
| 5,027,708 | A | 7/1991 | Gonzalez et al. |
| 5,042,594 | A | 8/1991 | Gonzalez et al. |
| 5,060,573 | A | 10/1991 | Montgomery et al. |
| 5,223,665 | A | 6/1993 | Burleson et al. |
| 5,571,986 | A | 11/1996 | Snider et al. |
| 5,603,384 | A | 2/1997 | Bethel et al. |
| 6,006,833 | A | 12/1999 | Burleson et al. |
| 6,012,525 | A | 1/2000 | Burleson et al. |
| 7,226,303 | B2 | 6/2007 | Shaikh |
| 7,364,451 | B2 | 4/2008 | Ring et al. |
| 7,591,212 | B2 | 9/2009 | Myers, Jr. et al. |
| 7,762,172 | B2 | 7/2010 | Li et al. |
| 7,913,603 | B2 | 3/2011 | LaGrange et al. |
| 8,181,718 | B2 | 5/2012 | Burleson et al. |
| 8,186,259 | B2 | 5/2012 | Burleson et al. |
| 8,230,932 | B2 | 7/2012 | Ratcliffe et al. |
| 8,844,127 | B2 | 9/2014 | Finke et al. |
| 8,875,787 | B2 | 11/2014 | Tassaroli |
| 9,080,433 | B2 | 7/2015 | Anclos et al. |
| 9,145,764 | B2 | 9/2015 | Burton et al. |
| 9,284,819 | B2 | 3/2016 | Tolman et al. |
| 9,494,021 | B2 | 11/2016 | Parks et al. |
| 9,518,454 | B2 | 12/2016 | Current et al. |
| 9,581,422 | B2 | 2/2017 | Preiss et al. |
| 9,605,937 | B2 | 3/2017 | Fitschberger et al. |
| 9,702,680 | B2 | 7/2017 | Parks et al. |
| 9,759,049 | B2 | 9/2017 | Hardesty et al. |
| 9,822,618 | B2 | 11/2017 | Eitschberger |
| 9,835,015 | B2 | 12/2017 | Hardesty et al. |
| 9,903,192 | B2 | 2/2018 | Entchev et al. |
| 10,066,921 | B2 | 9/2018 | Eitschberger |
| 10,077,641 | B2 | 9/2018 | Rogman et al. |
| 10,138,713 | B2 | 11/2018 | Tolman et al. |
| 10,174,595 | B2 | 1/2019 | Knight et al. |
| 10,273,788 | B2 | 4/2019 | Bradley et al. |
| 10,352,136 | B2 | 7/2019 | Goyeneche |
| 10,352,144 | B2 | 7/2019 | Entchev et al. |
| 10,352,674 | B2 | 7/2019 | Eitschberger et al. |
| 10,365,078 | B2 | 7/2019 | Eitschberger et al. |
| 10,386,168 | B1 | 8/2019 | Preiss et al. |
| 10,408,024 | B2 | 9/2019 | Hardesty et al. |
| 10,429,161 | B2 | 10/2019 | Parks et al. |
| 10,458,213 | B1 | 10/2019 | Eitschberger et al. |
| 10,472,938 | B2 | 11/2019 | Parks et al. |
| 10,507,433 | B2 | 12/2019 | Eitschberger et al. |
| 10,584,950 | B2 | 3/2020 | Saltarelli et al. |
| 10,597,979 | B1 | 3/2020 | Eitschberger et al. |
| 10,641,068 | B2 | 5/2020 | Hardesty et al. |
| 10,669,821 | B2 | 6/2020 | Knight et al. |
| 10,677,026 | B2 | 6/2020 | Kondou et al. |
| 10,689,955 | B1 | 6/2020 | Mauldin et al. |
| 10,731,444 | B2 | 8/2020 | Wells et al. |
| 10,844,697 | B2 | 11/2020 | Preiss et al. |
| 10,900,334 | B2 | 1/2021 | Knight et al. |
| 10,900,335 | B2 | 1/2021 | Knight et al. |
| 11,078,762 | B2 | 8/2021 | Mauldin et al. |
| 2005/0178282 | A1 | 8/2005 | Brooks et al. |
| 2005/0229805 | A1 | 10/2005 | Myers et al. |
| 2006/0018337 | A1 | 8/2006 | Finke et al. |
| 2007/0084336 | A1 | 4/2007 | Neves |
| 2007/0125540 | A1 | 6/2007 | Gerez et al. |
| 2007/0158071 | A1 | 7/2007 | Mooney et al. |
| 2007/0267195 | A1 | 11/2007 | Grigar et al. |
| 2008/0047456 | A1 | 2/2008 | Li et al. |
| 2008/0134922 | A1 | 6/2008 | Grattan et al. |
| 2008/0173204 | A1 | 7/2008 | Anderson et al. |
| 2009/0050322 | A1 | 2/2009 | Hill et al. |
| 2009/0272529 | A1 | 11/2009 | Crawford |
| 2009/0301723 | A1 | 12/2009 | Gray |
| 2010/0000789 | A1 | 1/2010 | Barton et al. |
| 2010/0024674 | A1 | 2/2010 | Peeters et al. |
| 2010/0089643 | A1 | 4/2010 | Vidal |
| 2010/0096131 | A1 | 4/2010 | Hill et al. |
| 2010/0163224 | A1 | 7/2010 | Strickland |
| 2012/0152542 | A1 | 6/2012 | Le |
| 2012/0160483 | A1 | 6/2012 | Carisella |
| 2012/0199031 | A1 | 8/2012 | Lanclos |
| 2012/0199352 | A1 | 8/2012 | Lanclos et al. |
| 2012/0247769 | A1 | 10/2012 | Schacherer et al. |
| 2012/0247771 | A1 | 10/2012 | Black et al. |
| 2012/0298361 | A1 | 11/2012 | Sampson |
| 2013/0008639 | A1 | 1/2013 | Tassaroli |
| 2013/0043074 | A1 | 2/2013 | Tassaroli |
| 2013/0062055 | A1 | 3/2013 | Tolman et al. |
| 2013/0118342 | A1 | 5/2013 | Tassaroli |
| 2013/0126237 | A1 | 5/2013 | Burton et al. |
| 2013/0199843 | A1 | 8/2013 | Ross |
| 2013/0248174 | A1 | 9/2013 | Dale et al. |
| 2014/0131035 | A1 | 5/2014 | Entchev et al. |
| 2015/0176386 | A1 | 6/2015 | Castillo et al. |
| 2015/0226044 | A1 | 8/2015 | Ursi et al. |
| 2015/0330192 | A1 | 11/2015 | Rogman et al. |
| 2016/0040520 | A1 | 2/2016 | Tolman et al. |
| 2016/0061572 | A1 | 3/2016 | Eitschberger et al. |
| 2016/0069163 | A1 | 3/2016 | Tolman et al. |
| 2016/0084048 | A1 | 3/2016 | Harrigan et al. |
| 2016/0168961 | A1 | 6/2016 | Parks et al. |
| 2016/0273902 | A1 | 9/2016 | Eitschberger |
| 2016/0290084 | A1 | 10/2016 | LaGrange et al. |
| 2016/0298404 | A1 | 10/2016 | Beckett et al. |
| 2016/0356132 | A1 | 12/2016 | Burmeister et al. |
| 2017/0030693 | A1 | 2/2017 | Preiss et al. |
| 2017/0052011 | A1 | 2/2017 | Parks et al. |
| 2017/0175500 | A1 | 6/2017 | Robey et al. |
| 2017/0211363 | A1 | 7/2017 | Bradley et al. |
| 2017/0241244 | A1 | 8/2017 | Barker et al. |
| 2017/0268860 | A1 | 9/2017 | Eitschberger |
| 2017/0276465 | A1 | 9/2017 | Parks et al. |
| 2017/0314372 | A1 | 11/2017 | Tolman et al. |
| 2017/0314373 | A9 | 11/2017 | Bradley et al. |
| 2018/0119529 | A1 | 5/2018 | Goyeneche |
| 2018/0135389 | A1 | 5/2018 | Sullivan |
| 2018/0202789 | A1 | 7/2018 | Parks et al. |
| 2018/0202790 | A1 | 7/2018 | Parks et al. |
| 2018/0274342 | A1 | 9/2018 | Sites |
| 2018/0299239 | A1* | 10/2018 | Eitschberger ..... H05K 5/069 |
| 2018/0318770 | A1 | 11/2018 | Eitschberger et al. |
| 2019/0040722 | A1 | 2/2019 | Yang et al. |
| 2019/0048693 | A1 | 2/2019 | Henke et al. |
| 2019/0049225 | A1 | 2/2019 | Eitschberger |
| 2019/0085685 | A1 | 3/2019 | McBride |

(56) References Cited

U.S. PATENT DOCUMENTS

| | | | |
|---|---|---|---|
| 2019/0162056 | A1 | 5/2019 | Sansing |
| 2019/0195054 | A1 | 6/2019 | Bradley et al. |
| 2019/0211655 | A1 | 7/2019 | Bradley et al. |
| 2019/0234188 | A1 | 8/2019 | Goyeneche |
| 2019/0257158 | A1 | 8/2019 | Langford et al. |
| 2019/0257181 | A1 | 8/2019 | Langford et al. |
| 2019/0284889 | A1 | 9/2019 | Lagrange et al. |
| 2019/0316449 | A1 | 10/2019 | Schultz et al. |
| 2019/0330947 | A1 | 10/2019 | Mulhern et al. |
| 2019/0368293 | A1 | 12/2019 | Covalt et al. |
| 2020/0024934 | A1 | 1/2020 | Eitschberger et al. |
| 2020/0024935 | A1 | 1/2020 | Eitschberger et al. |
| 2020/0032626 | A1 | 1/2020 | Parks et al. |
| 2020/0063537 | A1 | 2/2020 | Langford et al. |
| 2020/0088011 | A1 | 3/2020 | Eitschberger et al. |
| 2020/0182025 | A1 | 6/2020 | Brady |
| 2020/0199983 | A1 | 6/2020 | Preiss et al. |

FOREIGN PATENT DOCUMENTS

| | | | |
|---|---|---|---|
| WO | 2015006869 | A1 | 1/2015 |
| WO | 2015134719 | A1 | 9/2015 |
| WO | 2019148009 | A2 | 8/2019 |

OTHER PUBLICATIONS

CIPO Examination Search Report Issued in related Canadian Application No. 3,143,562; Report Issued: Aug. 25, 2023; 2 pages.
GEODynamics' EPIC™ Switches Brochure; GEODynamics; Copyright 2020; v.03; 1 page.
Josh Howk and Adam Dyess; "Mitigating the Problems in Select-Fire Perforating Operations" IPS 16-22; 2016 International Perforating Symposium Galveston; May 10, 2016; 15 pages.
Hunting Titan Brochure; Hunting Energy Services; Copyright 2020; v.9.1; 27 pages.
Screen Shot of CircuPool Flow Switch Housing(R); https://www.circupool.com/CircuPool%C2%AE-Flow-Switch-Housing_p_237.html; 2 pages.
Screen Shot of Chaparral Performance Machine Contour FL Right Side 5 Button Switch Housing; https://www.chapmoto.com/performance-machine-contour-fl-right-side-5-button-switch-housing-parent-397-pm3081; 2 pages.
Screen shot of OsoLite® Lite'n Your Workload with Oso's Prewired, Disposable Perforating Gun System; https://www.bsoperf.com/perf-hardware/osolite; Date of access of Feb. 1, 2021; 2 pages.
Screen shot of SWM International Inc. Thunder Disposable Gun System; https://web.archive.org/web/20200109183633/http:/swmtx.com/pdf/thunder_gun.pdf; Date of access of Feb. 1, 2021; 5 pages.
Screen shot of Yellow Jacket Oil Tools: Perforating Guns; https://www.yjoiltools.com/perforating-guns; Date of access of Feb. 1, 2021; 1 page.
Screen shot of Nexus Perforating: Double Nexus Connect (Thunder Gun System); https://www.yjoiltools.com/perforating-guns; Date of access of Feb. 1, 2021; 1 page.
Screen shot of VIGOR USA: Perforating Gun Accessories—Economical and Dependable Perforating Gun Accessories; https://vigorusa.com/perforating-gun-accessories/; Date of access of Feb. 1, 2021; 2 page.
Screen shot of Yellow Jacket Oil Tools: Pre-Wired Perforating Gun; https://www.yjoiltools.com/Perforating-Guns/Pre-Wired-Perforating-Gun; Date of access of Feb. 1, 2021; 1 page.
Screen shot of GR Energy Services- ZipFire™ ReFrac gun system; https://www.grenergyservices.com/zipfire-refrac/; Date of access of Feb. 1, 2021; 2 pages.
Screen shot of GR Energy Services—ZipFire™ high-efficiency perforating system answers current completion demands for higher stage-per-day performance; https://www.grenergyservices.com/zipfire/; date of access of Feb. 1, 2021; 2 pages.
Screen shot of Rock Faithwell—Perforating Gun System; http://www.cnrock.com.cn/h-col-116.html; date of access of Feb. 1, 2021; 2 pages.
Screen shot of APT American—Perforating Guns; https://aptamerican.com/perforating-guns; date of access of Feb. 1, 2021; 1 page.
Screen shot of NexTier—Innovative Solutions: GameChanger™ Perforating System; https://nextierofs.com/solutions/innovative-solutions/gamechanger/; date of access of Feb. 1, 2021; 2 pages.

* cited by examiner

BULKHEAD FOR A PERFORATING GUN ASSEMBLY

STATEMENT OF RELATED APPLICATIONS

The present application is filed as a Continuation-in-Part of U.S. Ser. No. 17/175,651. That application was filed on filed Feb. 13, 2021 and is entitled "Detonation System Having Sealed Explosive Initiation Assembly."

The '651 application was filed as a Continuation-in-Part of U.S. Ser. No. 16/996,692, filed Aug. 18, 2020. That application is also entitled "Detonation System Having Sealed Explosive Initiation Assembly."

The '692 application was filed as a Continuation-in-Part of U.S. Ser. No. 16/894,512 filed Jun. 5, 2020. That application is also entitled "Detonation System Having Sealed Explosive Initiation Assembly."

The '512 application claimed the benefit of U.S. Ser. No. 63/048,212 filed Jul. 6, 2020. That application was also entitled "Detonation System Having Sealed Explosive Initiation Assembly."

The '512 application further claimed the benefit of U.S. Ser. No. 62/987,743 filed Mar. 10, 2020. That application was entitled "Detonation System Having Sealed Explosive Initiation Assembly."

The '512 application further claimed the benefit of U.S. Ser. No. 62/890,242 filed Aug. 22, 2019.

The present application is also filed as a Continuation-In-Part of U.S. Ser. No. 17/164,531 filed Feb. 1, 2021, which is a Continuation-in-Part of U.S. Ser. No. 16/836,193 filed Mar. 31, 2020, now patented as U.S. Pat. No. 10,914,145. These applications are entitled "A Bulkhead Assembly for a Tandem Sub, and an Improved Tandem Sub."

U.S. Ser. No. 16/836,193 claimed the benefit of U.S. Ser. No. 62/845,692 filed May 9, 2019.

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

TECHNICAL FIELD OF THE INVENTION

The present disclosure relates to the field of hydrocarbon recovery operations. More specifically, the invention relates to a perforating gun assembly used for the perforation of steel casing in a wellbore. Further still, the invention relates to a bridged bulkhead for a perforating gun assembly, wherein a first signal pin in the bulkhead delivers detonation instructions in a first direction, while a second signal pin in the bulkhead delivers detonation signals from an addressable switch and back to a detonator in a second direction.

DISCUSSION OF THE BACKGROUND

For purposes of this disclosure, pending U.S. Ser. No. 16/996,692 will be referred to as "the parent application." The parent application is incorporated herein in its entirety by reference.

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a string of production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a near-horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is, wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore 100 is completed horizontally, meaning that a near-horizontal "leg" 156 is provided. The production casing 150 extends substantially across the horizontal leg 156.

It is observed that the annular region around the surface casing 120 is filled with cement 125. The cement (or cement matrix) 125 serves to isolate the wellbore 100 from fresh water zones and potentially porous formations around the casing string 120.

The annular regions around the intermediate casing strings 130, 140 are also filled with cement 135, 145.

Similarly, the annular region around the production casing 150 is filled with cement 155. However, the cement 135, 145, 155 is optionally only placed behind the respective casing strings 130, 140, 150 up to the lowest joint of the immediately surrounding casing string. Thus, a non-cemented annular area 132 is typically preserved above the cement matrix 135, a non-cemented annular area 142 may optionally be preserved above the cement matrix 135, and a non-cemented annular area 152 is frequently preserved above the cement matrix 155.

The horizontal leg 156 of the wellbore 100 includes a heel 153 and a toe 154. In this instance, the toe 154 defines the end (or "TD") of the wellbore 100. In order to enhance the recovery of hydrocarbons, particularly in low-permeability formations, the casing 150 along the horizontal section 156 undergoes a process of perforating and fracturing (or in some cases perforating and acidizing). Due to the very long lengths of new horizontal wells, the perforating and formation treatment process is typically carried out in stages.

In one method, a perforating gun assembly 200 is pumped down towards the end of the horizontal leg 156 at the end of a wireline 240. The perforating gun assembly 200 will include a series of perforating guns (shown at 210 in FIG. 2), with each gun having sets of charges ready for detonation. The charges associated with one of the perforating guns are detonated and perforations (not shown) are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations create fluid communication with the surrounding formation 115 (or pay zone) so that hydrocarbon fluids can flow into the casing 150.

After perforating, the operator will fracture (or otherwise stimulate) the formation 115 through the perforations (not shown). This is done by pumping treatment fluids into the formation 115 at a pressure above a formation parting pressure. After the fracturing operation is complete, the wireline 240 will be raised from the surface and the perforating gun assembly 200 will be positioned at a new location (or "depth") along the horizontal wellbore 156. A plug (such as plug 112) is set below the perforating gun assembly 200 using a setting tool 160, and new shots are fired in order to create a new set of perforations. Thereafter, treatment fluid is again pumping into the wellbore 100 and into the formation 115. In this way, a second set (or "cluster") of fractures is formed away from the wellbore 156.

The process of setting a plug, perforating the casing, and fracturing the formation is repeated in multiple stages until the wellbore has been completed, that is, it is ready for production. A string of production tubing (not shown) is then placed in the wellbore to provide a conduit for production fluids to flow up to the surface 105.

In order to provide perforations for the multiple stages without having to pull the perforating gun 200 after every detonation, the perforating gun assembly 200 employs multiple guns in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface 105 and delivers electrical energy down to the tool string 200. Each perforating gun 210 also includes an explosive initiator, or "detonator" (shown in phantom at 229). The detonator 229 is typically a small aluminum housing having a resistor inside. The detonator 229 receives electrical energy from the surface 105 and through the e-line 240, which heats the resistor.

The detonator 229 is surrounded by a sensitive explosive material such as RDX. When current is run through the detonator 229, a small explosion is set off by the electrically heated resistor. Stated another way, the explosive compound is ignited by the detonator 229. This small explosion sets off an adjacent detonating cord (not shown). When ignited, the detonating cord initiates one or more shots, typically referred to as "shaped charges." The shaped charges (shown at 320 in FIG. 3) are held in an inner tube (shown at 300 in FIG. 3), referred to as a carrier tube, for security and discharge through openings 215 in the selected gun barrel 212. As the RDX is ignited, the detonating cord propagates an explosion down its length to each of the shaped charges 320 along the carrier tube 300.

The perforating gun assembly 200 may include short centralizer subs 220. The assembly 200 also includes the inner tubes 300, which reside within the gun barrel housings 212 and are not visible in FIG. 2. In addition, tandem subs 225 are used to connect the gun barrel housings 212 end-to-end. Each tandem sub 225 comprises a metal threaded connector placed between the gun barrels 210. Typically, the gun barrels 210 will have female-by-female threaded ends while the tandem sub 225 has opposing male threaded ends.

The perforating gun assembly 200 with its long string of gun barrels (the housings 212 of the perforating guns 210 and the carrier tubes 300) is carefully assembled at the surface 105, and then lowered into the wellbore 10 at the end of the e-line 240. The e-line 240 extends upward to a control interface (not shown) located at the surface 105. An insulated connection member 230 connects the e-line 240 to the uppermost perforating gun 210. Once the assembly 200 is in place within a wellbore, an operator of the control interface sends electrical signals to the perforating gun assembly 200 for detonating the shaped charges 320 and for creating perforations into the casing 150.

After the casing 150 has been perforated and at least one plug 112 has been set, the setting tool 120 and the perforating gun assembly 200 are taken out of the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore (typically through coiled tubing) for fracturing purposes. For a formation fracturing operation, the pump rate will create downhole pressure that is above the formation parting pressure.

As noted, the above operations may be repeated multiple times for perforating and/or fracturing the casing 150 at multiple locations, corresponding to different stages of the well. Multiple plugs may be used for isolating the respective stages from each other during the perforating phase and/or fracturing phase. When all stages are completed, the plugs are drilled out and the wellbore 100 is cleaned using a circulating tool.

It can be appreciated that reliable electrical connections must be made between the gun barrels 210 in the tool string 200 through each tandem sub 225. Some of those connections are made through so-called bulkheads. Bulkheads are small, electrically insulative tubular bodies that hold one or more signal pins. The connection between signal wires and the ends of the signal pins represents a point of potential weakness.

Therefore, a need exists for a bulkhead wherein the non-conductive outer housing is molded over (or "over-molded onto") the electrical wires. A need further exists for a detonation system wherein a pair of bulkheads are bridged together in fixed relation, with a first signal pin in the bulkhead delivering detonation instructions in a first direction, while a second signal pin in the bulkhead delivers detonation signals from an addressable switch and back to a detonator in a second direction. A need further exists for a bridged bulkhead assembly that resides within a carrier end plate, wherein the end plate seals off a tandem sub from wellbore fluids and debris following detonation of explosive charges in an associated perforating gun.

SUMMARY OF THE INVENTION

A bulkhead for transmitting detonation signals is provided. The bulkhead is designed for use with a perforating gun assembly for perforating a wellbore.

The bulkhead comprises an elongated tubular body having a first end, and a second end opposite the first end. A bore extends from the first end to the second end.

The bulkhead includes a signal pin residing within the bore of the bulkhead. The signal pin also has a first end, and a second end opposite the first end. An electrically conductive wire is connected to the second end of the signal pin at the second end of the bulkhead.

The bulkhead also comprises an end piece. The end piece extends from and is preferably integral to the second end of the bulkhead. The end piece closely holds the conductive wire in place. Preferably, the second end of bulkhead is over-molded to securely hold the detonator wire.

In one aspect, the second end of the signal pin resides within the end piece of the body. In one aspect, the first end of the signal pin comprises a banana clip that extends out from the first end of the bulkhead.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DEFINITIONS

Figure 1:
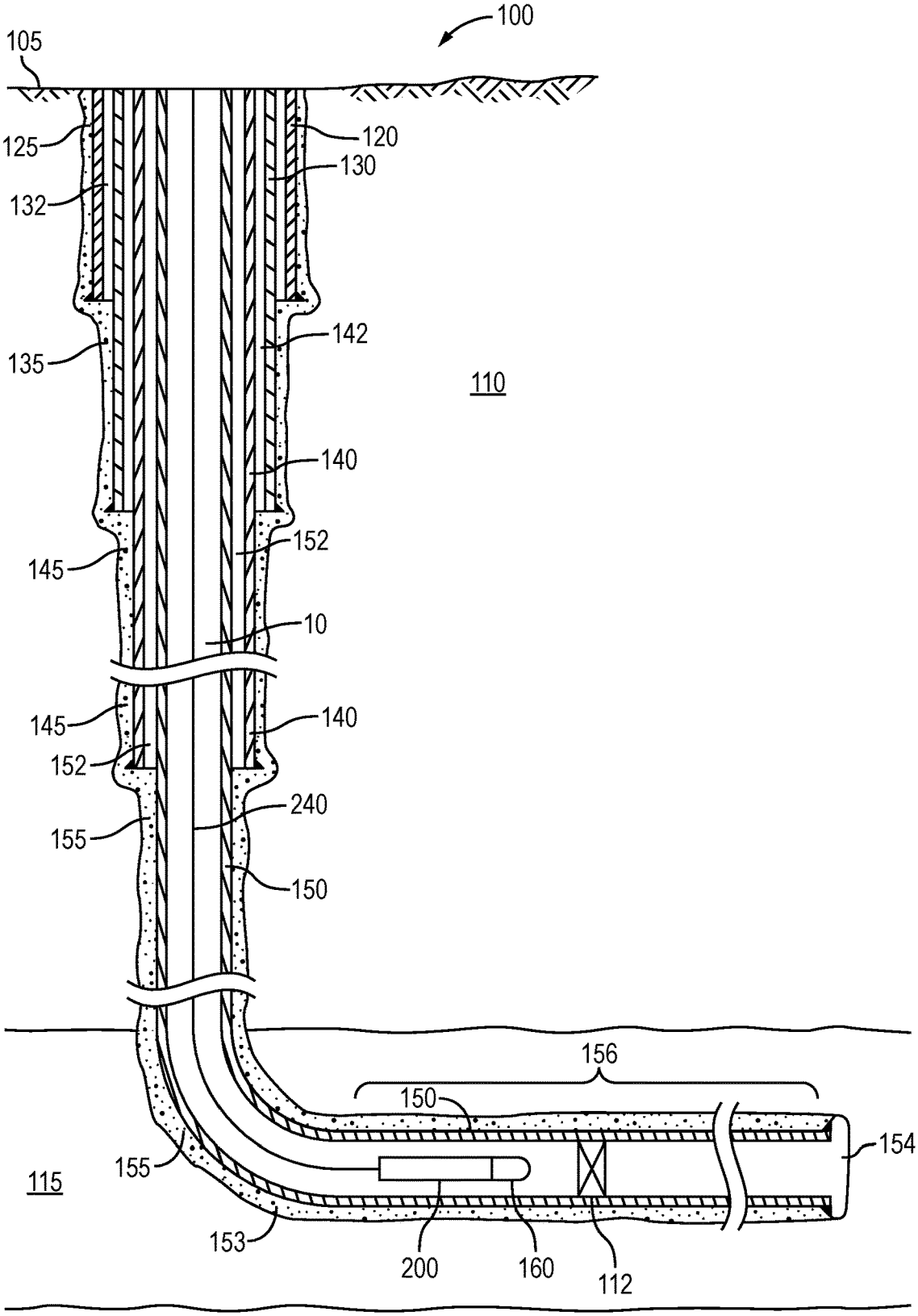
FIG. 1 (Prior Art)
FIG. 1 is a cross-sectional side view of a wellbore. The wellbore is being completed with a horizontal leg. A perforating gun assembly is shown having been pumped into the horizontal leg at the end of an e-line.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the invention; instead, the scope of the invention is defined by the appended claims.

The following embodiments are discussed, for simplicity, with regard to attaching two perforating guns to each other through a tandem sub. In the following, the terms "upstream" and "downstream" are being used to indicate that one gun barrel of a perforating gun may be situated above and one below, respectively. However, one skilled in the art would understand that the invention is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 3:
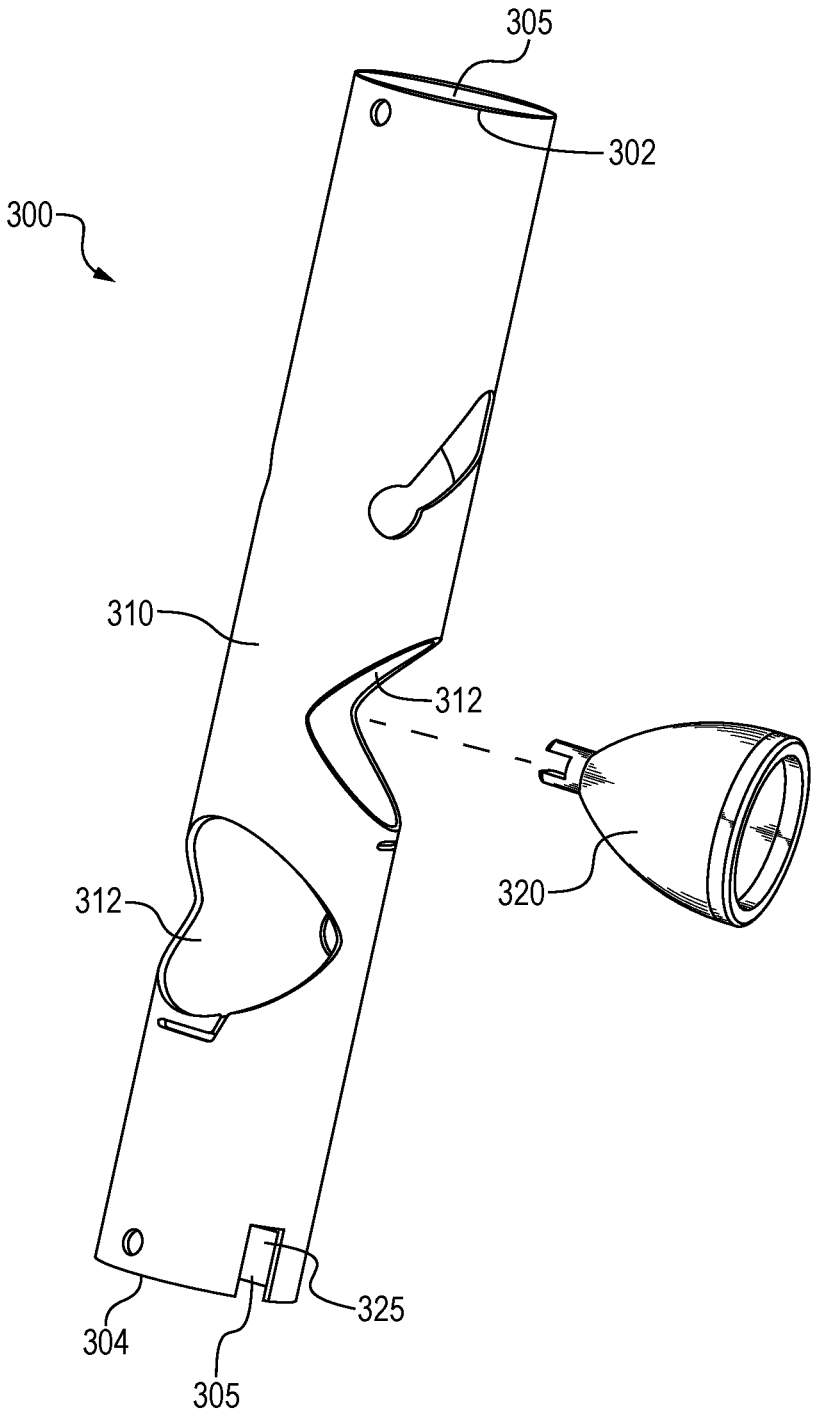
FIG. 3 is a perspective view of an illustrative carrier tube for a perforating gun. A charge is shown in separated relation.

FIG. 3 is a perspective view of an illustrative carrier tube 300 for a perforating gun 210. The carrier tube 300 defines an elongated tubular body 310 having a first end 302 and a second end 304 opposite the first end 302. The carrier tube 300 has an inner bore 305 dimensioned to receive charges. A single illustrative charge is shown at 320 in exploded-apart relation. Openings 312 are provided for receiving the charges 320 and enabling the charges 320 to penetrate a surrounding casing string 150 upon detonation.

Figure 4A:
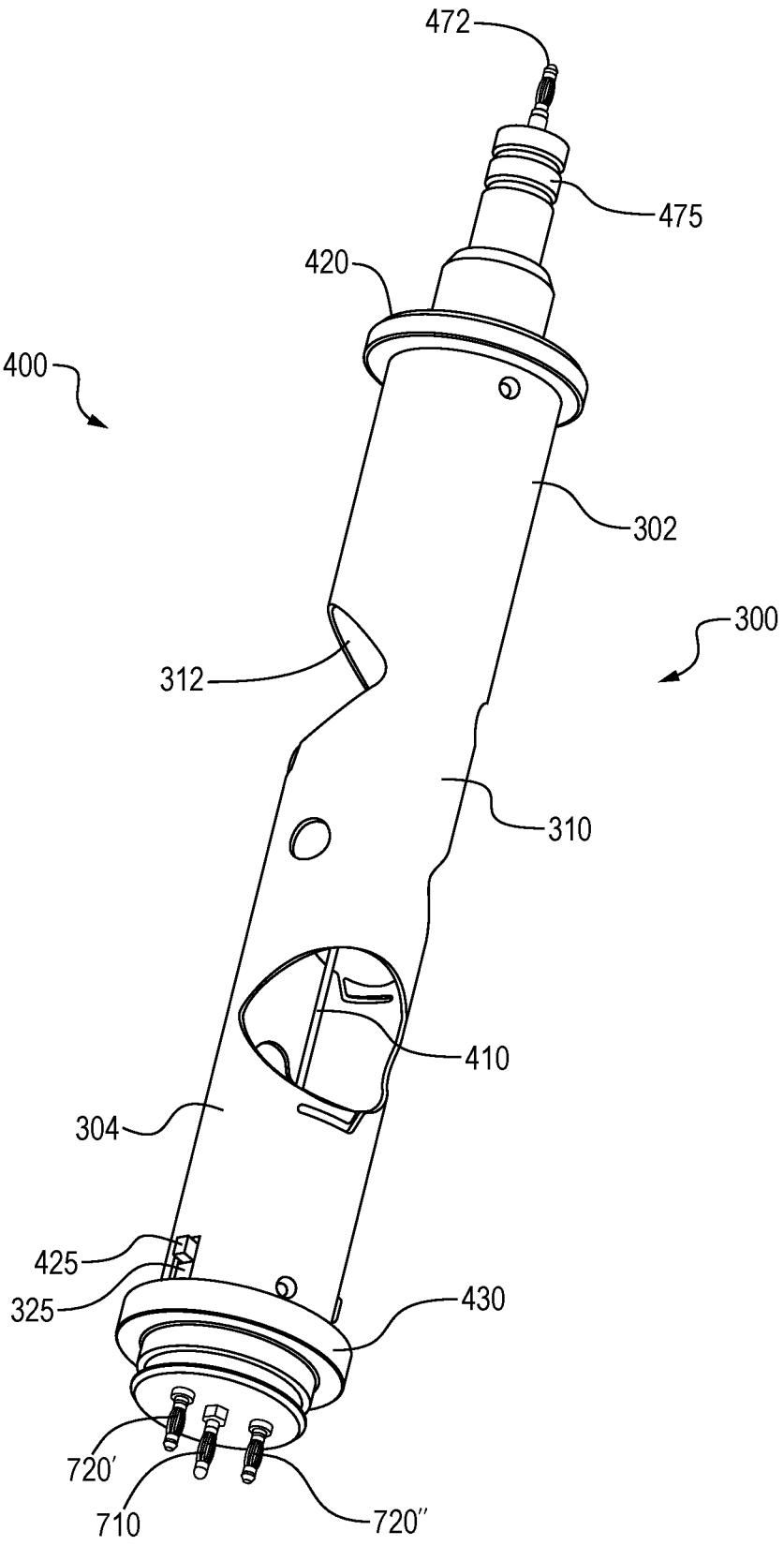
FIG. 4A is a perspective view of the carrier tube of FIG. 3. The carrier tube has received a top end plate and a bottom end plate. An electric line is shown extending through the carrier tube and to the bottom end plate.

FIG. 4A is a perspective view of the carrier tube 300 of FIG. 3. In this view, a pair of end plates have been threadedly connected to opposing ends of the carrier tube 300, forming a part of a perforating gun assembly 400. These represent a top end plate 420 connected at end 302, and a bottom end plate 430 connected at the bottom end 304. The end plates 420, 430 have mechanically enclosed the top 302 and bottom 304 ends of the carrier tube 300, respectively.

Figure 4B:
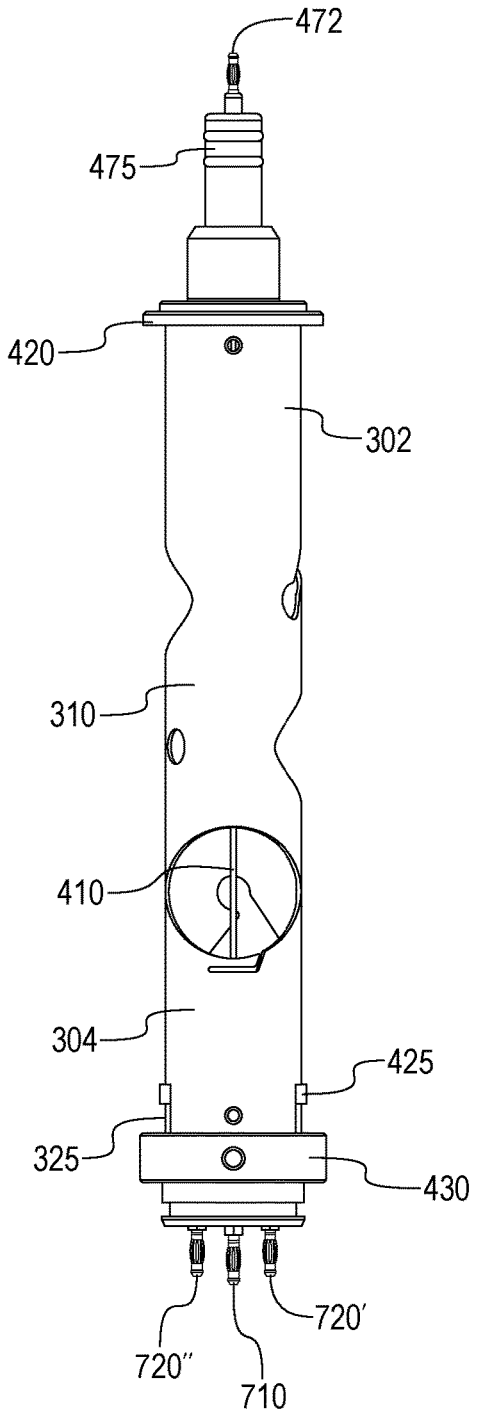
FIG. 4B is a first side view of the carrier tube of FIG. 4A.

The end plates 420, 430 help center the carrier tube 300 and its charges 320 within an outer gun barrel (not shown in FIG. 4A but shown at 510 in FIG. 4B). For this reason, they may be referred to as "carrier plates" 420, 430.

It is understood that each opening 312 along the carrier tube body 310 will receive and accommodate a shaped charge 320. Each shaped charge 320, in turn, is designed to detonate in response to an explosive signal passed through a detonating cord. It is understood that the carrier tube 300 and the shaped charge 320 of FIGS. 3 and 4A are illustrative, and that the current inventions are not limited to any particular type, model or configuration of charges, carrier tubes or gun barrels unless expressly so provided in the claims.

An electronic detonator (shown at 229 in FIG. 2) and a detonating cord reside inside the carrier tube 300. The carrier tube 300 and the gun barrel 510 are intended together to be illustrative of any standard perforating gun, so long as the gun provides a detonator and detonating cord internal to the carrier tube 300.

Extending up from the top end plate 420 is a bulkhead 475. The bulkhead 475 encloses a contact pin 470. The contact pin 470 is configured to transmit detonation and communication signals from the surface, and down to addressable switches (not shown) along the perforating gun string 200. The contact pin 470 and bulkhead 475 are shown in greater detail in FIGS. 10B and 10C, described below.

A signal transmission line 410 is seen extending down from the contact pin 470 and through the carrier tube 300. The signal transmission line 410 further extends through the bottom end plate 430, and down to a next perforating gun (not shown). A signal carried by the signal transmission line 410 is transmitted through a signal transmission pin 720'. An earlier embodiment of the signal transmission pin 720' is discussed in greater detail in FIGS. 7A, 22A and 22B of the parent application.

At the opposite end of the carrier tube 300, the bottom end plate 430 is shown. The bottom end plate 430 has a closed end surface 435 (shown at 435 in FIGS. 5A and 5B). Three pins are shown extending out of the closed end surface 435. These represent a ground pin 710 and two electrical pins 720', 720". In one aspect, ground pin 710 connects to the bottom end plate 430 as an electrical ground, while electrical pins 720', 720" connect to white and green wires, respectively. Electrical pin 720' serves as a signal transmission pin while electrical pin 720" serves as a detonator pin.

Details concerning the ground pin 710 are discussed in connection with FIGS. 9A and 9B of the parent application and need not be repeated herein. For reference, ground pin 710 is seen in the cross-sectional view of FIG. 10A herein.

Note that the ground pin 710 does not extend through the end plate 430 but simply extends from the end surface 435.

Figure 4C:
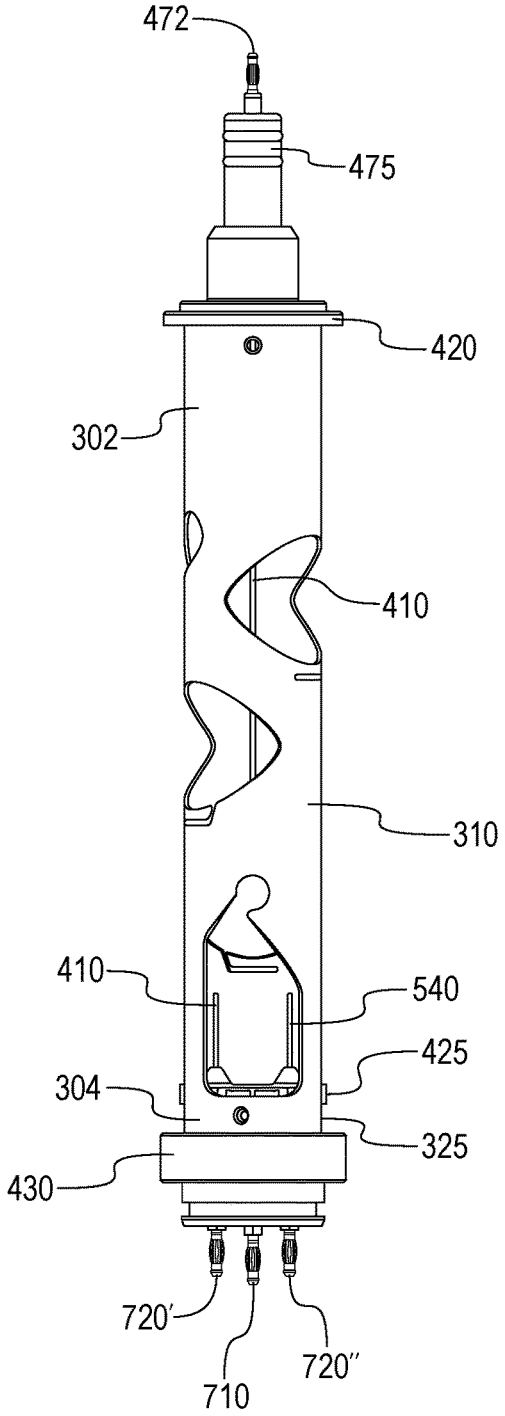
FIG. 4C is a second side view of the carrier tube of FIG. 4A, opposite the view of FIG. 4B.

FIG. 4B is a first side view of the carrier tube 300 of FIG. 4A. FIG. 4C is a second side view of the carrier tube 430 of FIG. 4A, opposite the view of FIG. 4B. Of interest, the charges 320 have been removed, leaving the signal transmission line 410 visible.

Figure 4D:
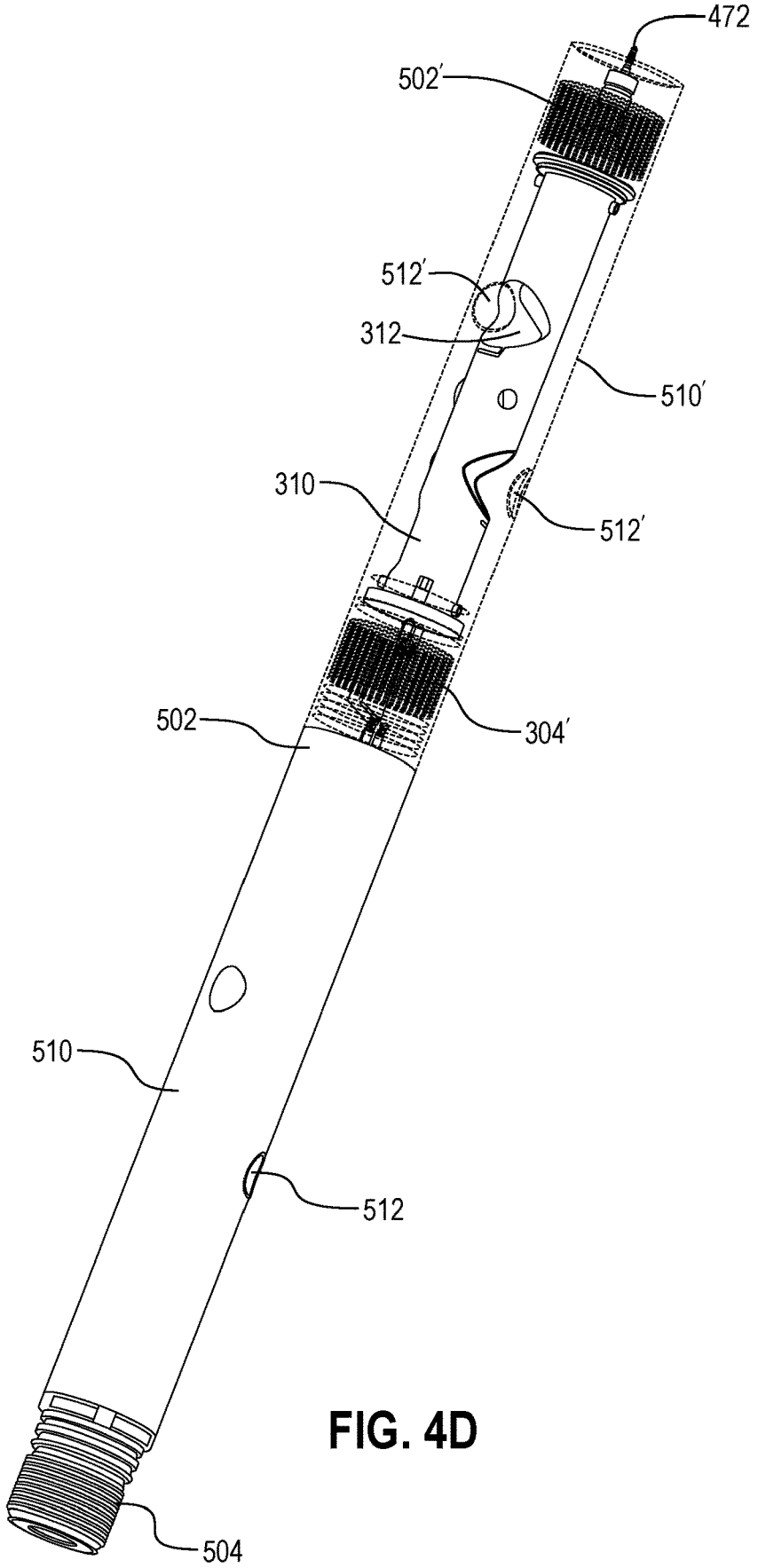
FIG. 4D is a perspective view of the carrier tube of FIG. 4A. Here, the carrier tube is being slidably received within a gun barrel housing.

FIG. 4D is another perspective view of the carrier tube 300 of FIG. 3. Here, the carrier tube 300 is being slidably received within a gun barrel housing 510. The gun barrel housing 510 has an upper end 502 and a lower end 504. The gun barrel housing 510 has a length that is generally conterminous with the length of the carrier tube 300. The gun barrel housing 510 includes openings 512 that align with openings 312 of the carrier tube body 310 when the gun barrel housing 510 is slid in place over the carrier tube 300.

In the view of FIG. 4D, the gun barrel housing 510 is shown in phantom when placed over the carrier tube 300. The upper end is indicated at 502' while the lower end is shown at 504'. Openings along the gun barrel housing 510 are provided at 512'. It is understood that this assembly typically takes place at the shop before delivery of a perforating gun assembly 400 to a well site.

In the arrangement of FIGS. 4A through 4D, the carrier tube body 310 and gun barrel housing 510 are downstream from the contact pin 470. However, it is understood that a separate carrier tube and gun barrel housing reside upstream from the contact pin 470. Similarly, separate carrier tubes and gun barrel housings reside downstream from the pins 710, 720', 720", forming what may be a long series of perforating guns in a gun barrel string.

Figure 5A:
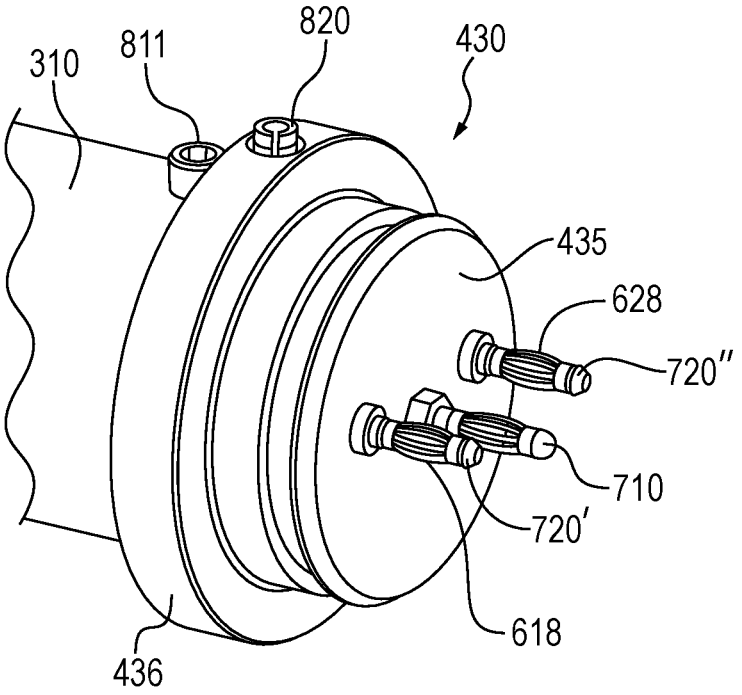
FIG. 5A is a first perspective view of the bottom end plate of FIG. 4A. The end plate is connected to the carrier tube. Three electrical pins are shown extending out of the end plate.

FIG. 5A is a first perspective view of the bottom end plate 430 of FIG. 4A. The end plate 430 is slidably connected to the body 310 of the carrier tube 300 at end 304. A bolt 811 threadedly connects a proximal end 432 of the end plate 430 to the lower end 304 of the carrier tube 300.

Figure 5B:
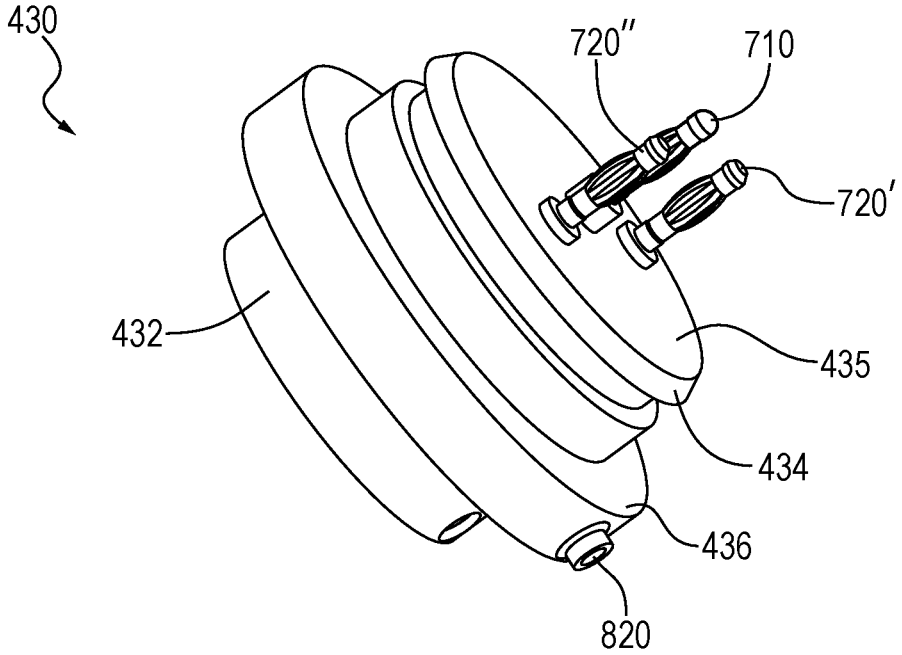
FIG. 5B is a second perspective view of the bottom end plate of FIG. 4A. The carrier tube has been removed for illustrative purposes.

FIG. 5B is a second perspective view of the bottom end plate 430. In this view, the proximal end 432 and distal end 434 of the carrier plate 430 are visible. Also shown is the closed end surface 435 and a central flange 436. The central flange 436 receives the lowermost end 504 of the gun barrel housing 510. The central flange 436 also receives bolt 820. Of interest, the ground pin 710 and electrical pins 720', 720" are visible.

Pins 720' and 720" reside within separate bulkheads. Because the pins 720' and 720" and their associated bulkheads are extremely small (certainly smaller than bulkhead 475 of FIG. 4A), the bulkheads may be referred to as "mini-bulkheads." In the present disclosure, a unique "bridged" bulkhead assembly is provided. The bridged bulkhead assembly provides an efficient way to installed prewired pins into the carrier end plate 430 for field-connection with the addressable switch (shown at 760 in FIG. 10A).

Figure 6A:
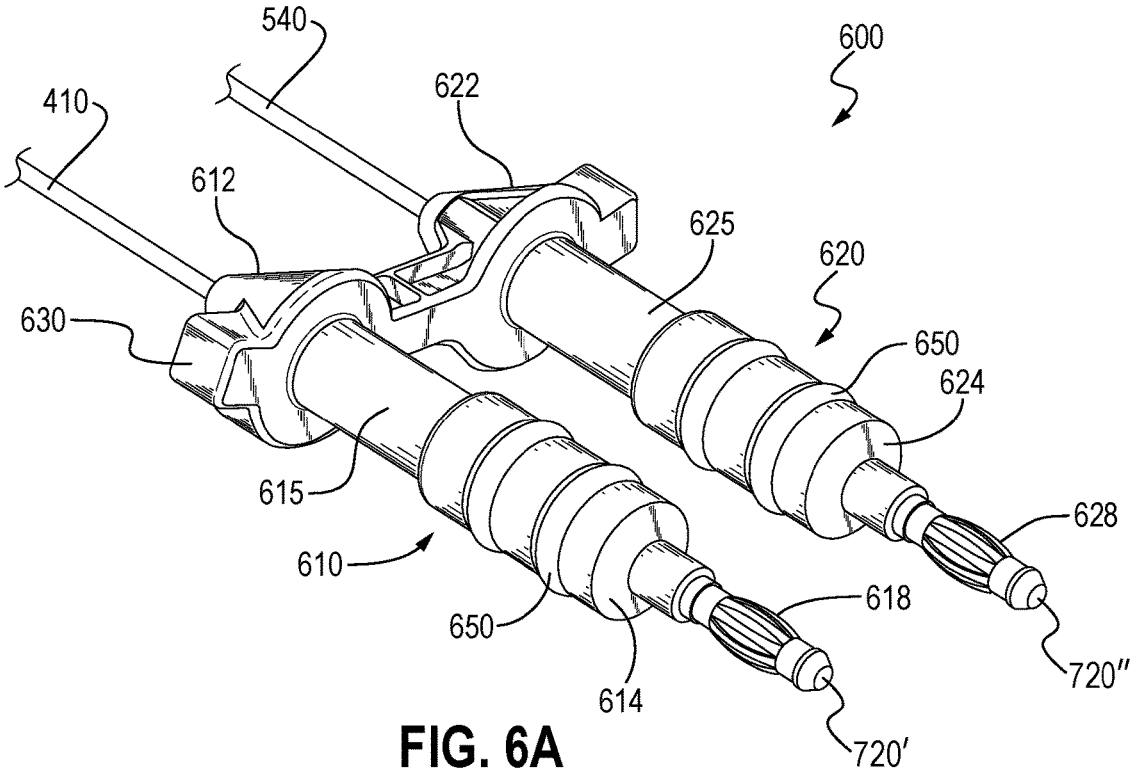
FIG. 6A is a first perspective view of a bridged bulkhead assembly of the present invention, in one embodiment. The bulkhead assembly holds a signal transmission pin and a separate detonation pin.

FIG. 6A is a first perspective view of a bridged bulkhead assembly 600 of the present invention, in one embodiment. The bulkhead assembly 600 holds the signal transmission pin 720' and the detonation pin 720".

Figure 6B:
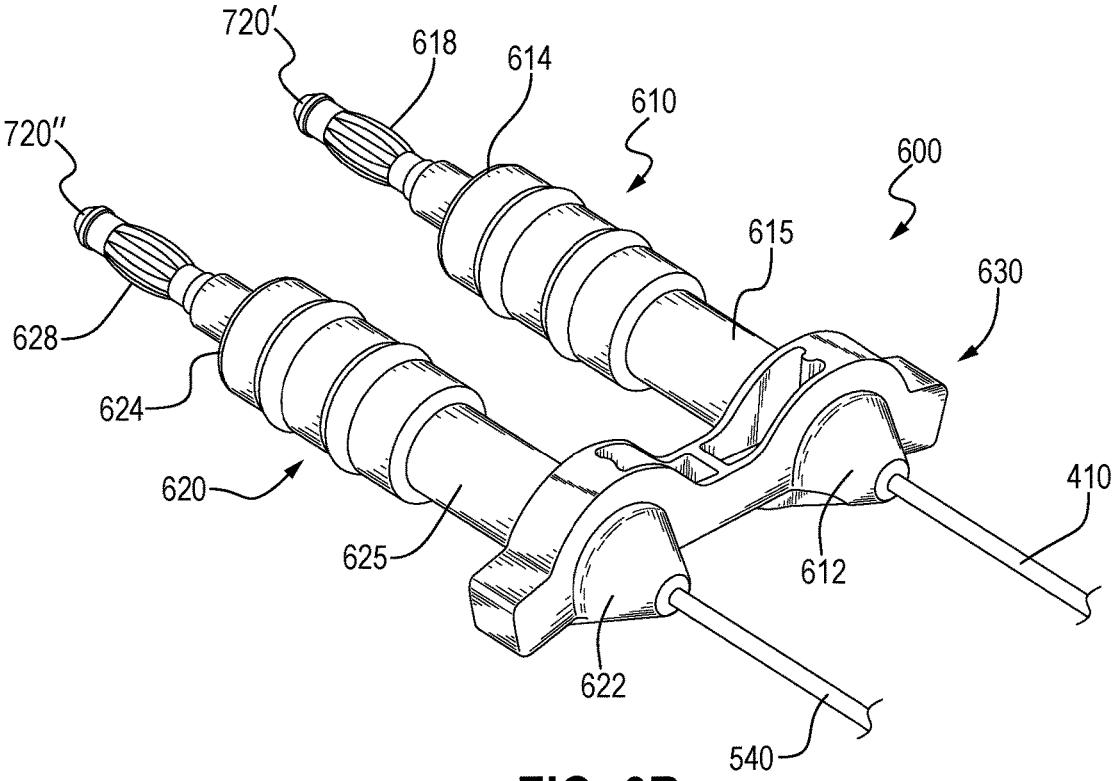
FIG. 6B is a second perspective view of the bridged bulkhead assembly of FIG. 6A. Here, the view is seen from an opposite end.

FIG. 6B is a second perspective view of the bridged bulkhead assembly 600 of FIG. 6A. Here, the view is seen from an end that is opposite the end of FIG. 6A. Note that the assembly 600 has also been flipped upside down relative to FIG. 6A.

In each of FIGS. 6A and 6B, a first bulkhead is shown at 610, while a second bulkhead is shown at 620. Bulkhead 610 has a first end 612, and a second end 614 opposite the first end 612. Similarly, bulkhead 620 has a first end 622, and a second end 624 opposite the first end 622. Bulkhead 610 is made up of body 615 while bulkhead 620 is made up of body 625. Each of bodies 615, 625 is fabricated from an electrically non-conductive material. In one aspect, the bodies 615, 625 are fabricated through an additive manufacturing process.

Signal transmission line 410 feeds into the first end 612 of the first bulkhead 610. The signal transmission line 410 is securely connected to a first end of the signal transmission pin 720'. This is seen more fully in the cross-sectional view of FIG. 9, discussed below.

In a similar way, a detonator wire 540 extends out from the first end 622 of the second bulkhead 620. The detonator wire 540 is securely connected to a first end of the detonator pin 720". This is also shown more fully in the cross-sectional view of FIG. 9.

Of interest, a second end 618 of the signal transmission pin 720' extends out from the second end 614 of the first bulkhead 610. Similarly, a second end 628 of the detonator pin 720" extends out from the second end 624 of the second bulkhead 620. Each of these second ends 618, 628 represents a banana clip.

FIGS. 6A and 6B also show a bridge 630. The bridge 630 connects and also spaces apart the first 610 and second 620 bulkheads.

Figure 7A:
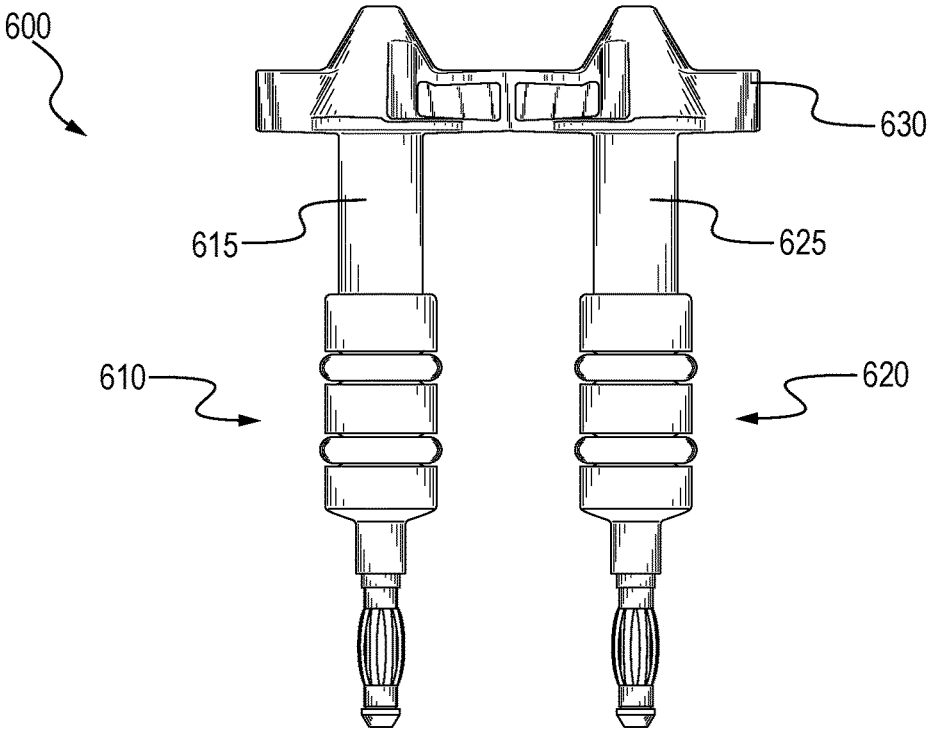
FIG. 7A is a top view of the bridged bulkhead assembly of FIGS. 6A and 6B
Figure 7B:
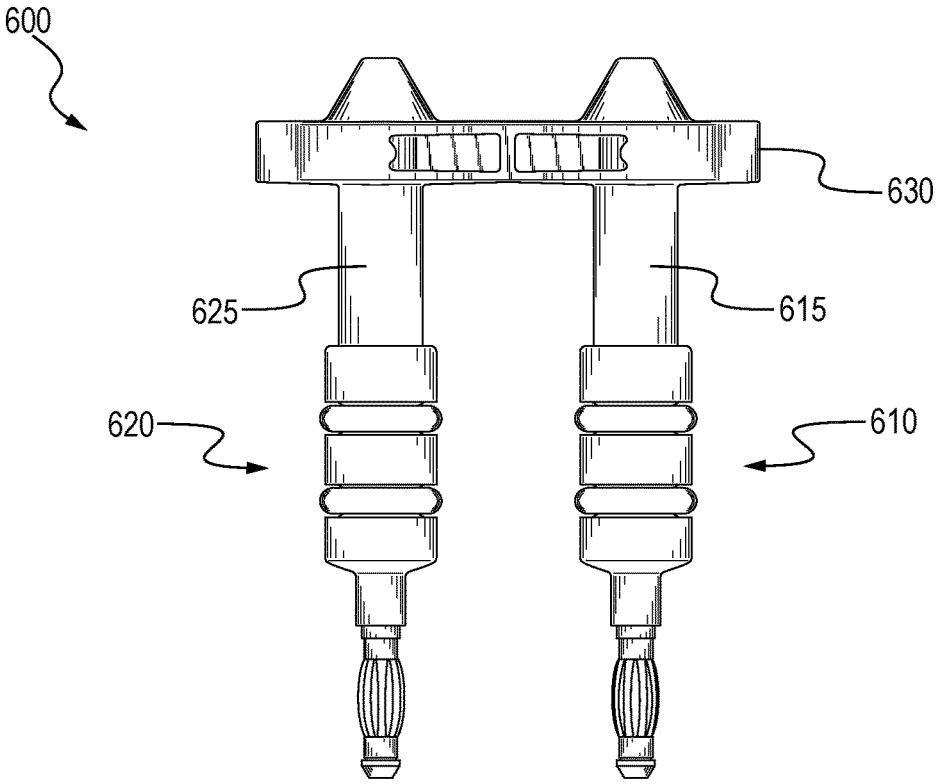
FIG. 7B is a bottom view of the bridged bulkhead assembly of FIGS. 6A and 6B

FIG. 7A is a top view of the bridged bulkhead assembly 600 of FIGS. 6A and 6B. FIG. 7B is a bottom view of the bridged bulkhead assembly 600 of FIGS. 6A and 6B. In the views of FIGS. 7A and 7B, the wires (signal transmission line) 410 and (detonator line) 540 have been removed for illustrative purposes.

Figure 8A:
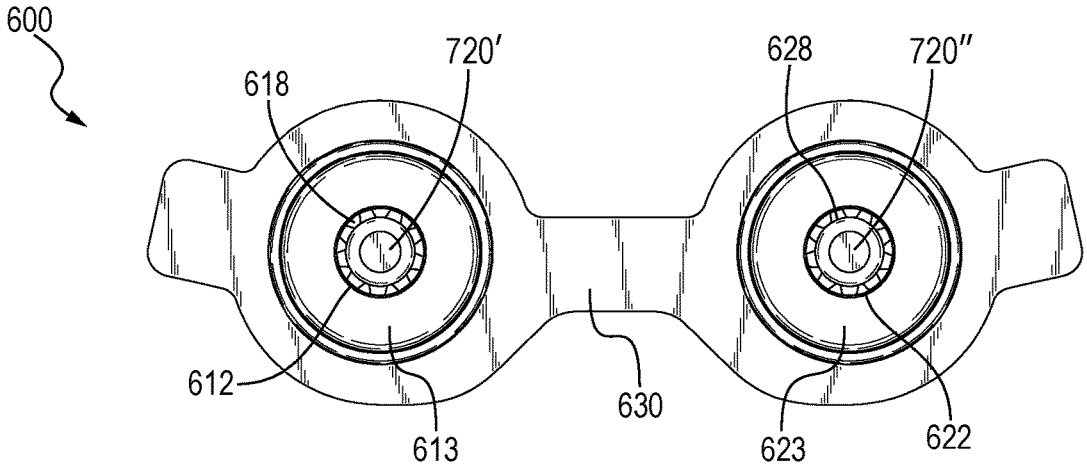
FIG. 8A is a front end view (or downstream view) of the bulkhead assembly of FIGS. 6A and 6B.
Figure 8B:
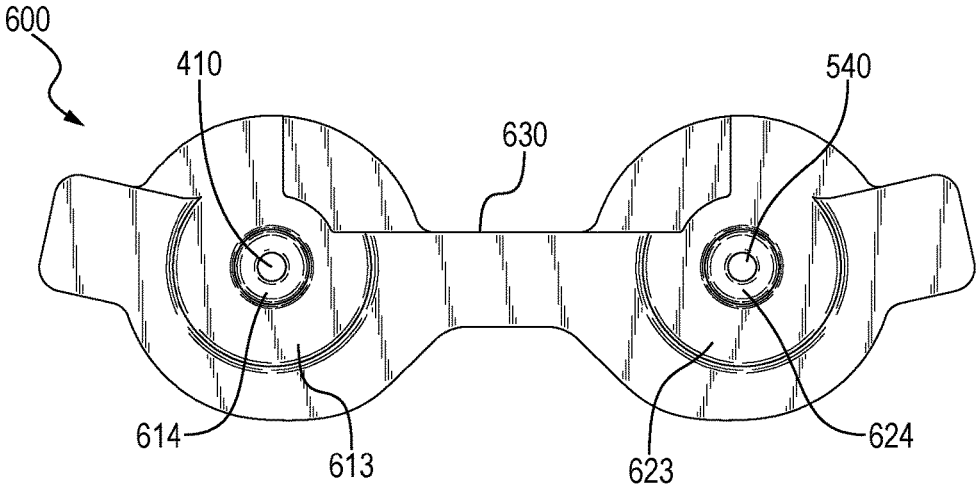
FIG. 8B is a rear end view (or upstream view) of the bulkhead assembly of FIGS. 6A and 6B.

FIG. 8A is a front end view of the bulkhead assembly 600 of FIGS. 6A and 6B. FIG. 8B is a rear end view of the bulkhead assembly of FIGS. 6A and 6B. In these views, openings 613, 623 are shown. The opening 613 receives the body 615 of the first bulkhead 610, while the opening 623 receives the body 625 of the second bulkhead 620. In one aspect, the openings 613, 623 are true through-openings extending through the bridge 630 for receiving the respective bodies 615, 625. Alternatively, the bridge 630 and the bodies 615, 625 are integral pieces having been formed through injection molding or through an additive manufacturing process.

Figure 8C:
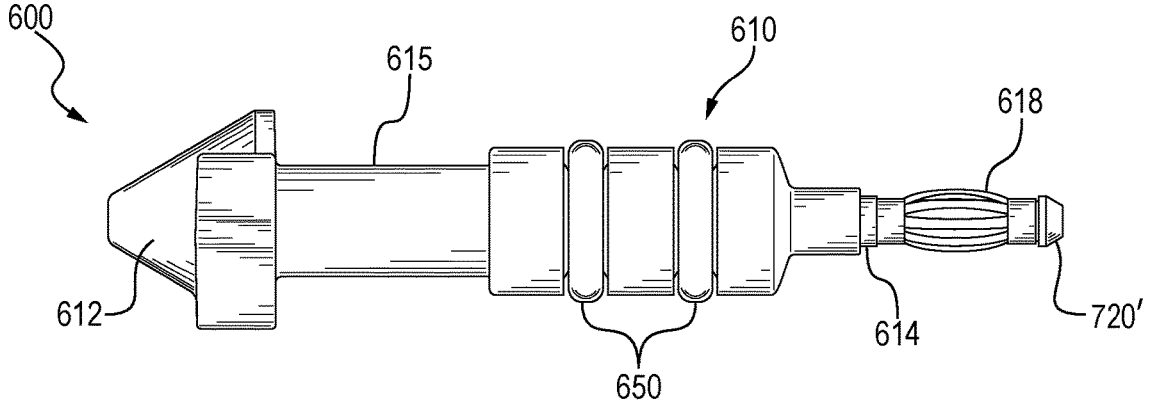
FIG. 8C is a side view of the bridged bulkhead assembly of FIG. 6A.

FIG. 8C is a side view of the bridged bulkhead assembly 600 of FIGS. 6A and 6B. This view is taken from the side of the first bulkhead 610. It is understood that signal transmission line 410 (not shown) will extend out of the first end 612.

Figure 9:
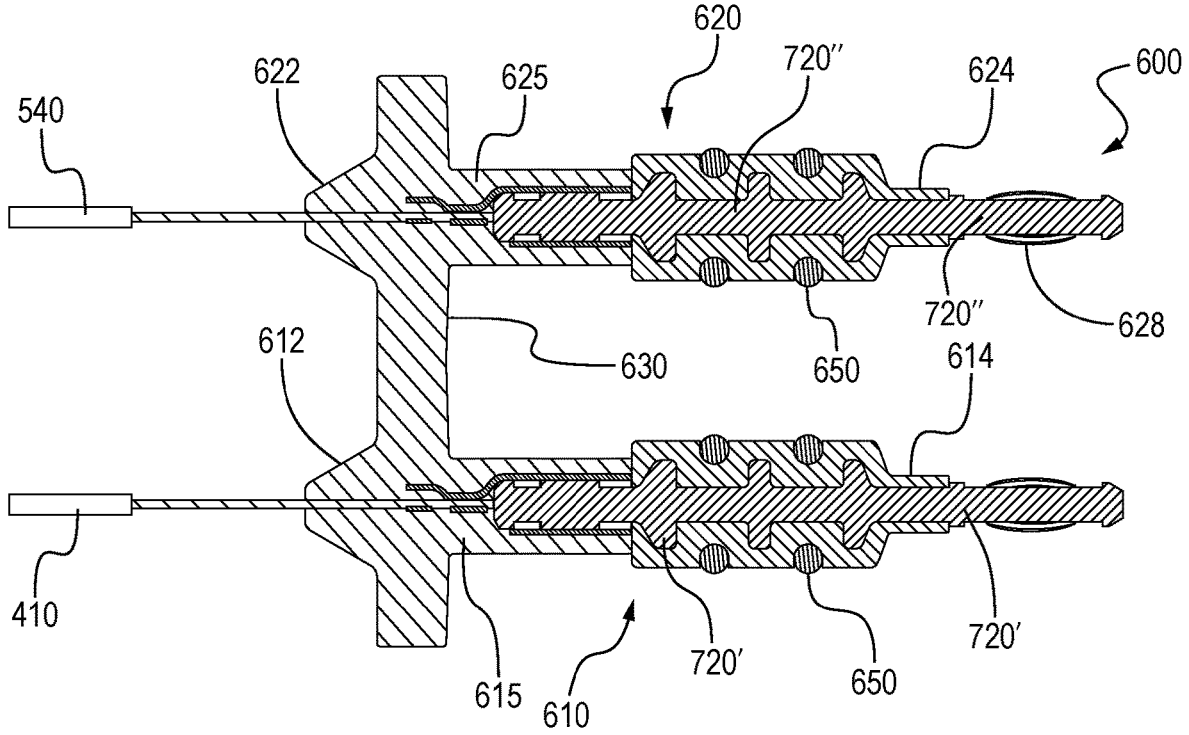
FIG. 9 is a cross-sectional view of the bridged bulkhead assembly of FIGS. 6A and 6B.

FIG. 9 is a cross-sectional view of the bridged bulkhead assembly 600 of FIGS. 6A and 6B. In this view, the signal transmission pin 720' is seen residing within the body 615 of the first bulkhead 610. At the same time, the detonator pin 720" is seen residing within the body 625 of the second bulkhead 620. Each of the signal transmission pin 720' and the detonator pin 720" is an electrically conductive pin. Preferably, each of the pins 720', 720" represents a single pin housed within a respective bulkhead that transmits electrical signals through the bulkheads 610, 620, respectively, in support of downhole perforating operations. The brass pins 720', 720" have a series of radial steps designed to keep the pins 720', 720" within the respective bulkheads 610, 620 to ensure a high pressure barrier when the upstream perforating gun is detonated.

It can be seen in FIG. 9 that the signal transmission line 410 is now connected to the signal transmission pin 720' at the first end 612 of the first bulkhead 610. At the same time, a detonator wire 540 is connected to the detonator pin 720" at the first end 622 of the second bulkhead 620. Preferably, the first bulkhead 610 is over-molded at the first end 612 to securely hold the signal transmission line 410, while the second bulkhead 620 is over-molded at its first end 622 to securely hold the detonator wire 540. It is understood that each of wires 410 and 540 will be properly insulated.

It is noted that over-molding the wires 410, 540 removes the need to connect the wires during assembly in the field. Over-molding also removes the risk of the wires being installed incorrectly and removes the need for separate insulators to cover the exposed brass/wire connection. The wires 410, 540 are internally connected to the respective brass pins 720', 720" via crimping without need of a transition terminal. Additional seal surfaces or components are not required, provided that the mold is sealed to the wire insulation without damaging it.

During assembly, the signal transmission line 410 is crimped to a bullet terminal, and the bullet terminal is then connected to the brass pin 720'. Similarly, the detonator wire 540 is crimped to a bullet terminal, and the bullet terminal is then connected to the brass pin 720". The over-molding then takes place. The result is that the "gun shop" no longer has to connect the terminal and wire to the bulkhead or add insulator boots, and a much more secure connection is provided.

In a preferred arrangement, the body 615 of the first bulkhead 610 extends into a first opening of the carrier end plate 430. At the same time, the body 625 of the second bulkhead 620 extends into a second opening of the end plate 430. O-rings 650 circumnavigate the bodies 615, 625, providing a seal within the openings of the end plate 430. As noted in connection with FIGS. 4A and 5A, the end plate 430 is a carrier end plate that resides at a lower end 304 of a perforating gun carrier tube 300.

Preferably, each bulkhead 610, 620 includes compliant tabs. The tabs are seen partially at 425 in FIG. 4A. The tabs 425 are configured to mate with slots 325 in the carrier tube 300 at end 304. This ensures a proper orientation of the pins 720', 720". Once the bulkheads 610, 620 are installed, the bulkheads 610, 620 are unable to back out of the end plate 430. This removes the need for retainer nuts or other retention parts.

The signal transmission pin 720' transmits detonation signals through the end plate 430 in a first direction. At the same time, the detonator pin 720" transmits the detonation signals back up through the end plate 430 in a second direction opposite the first direction. Preferably, the first direction is downstream while the second direction is upstream.

Figure 10A:
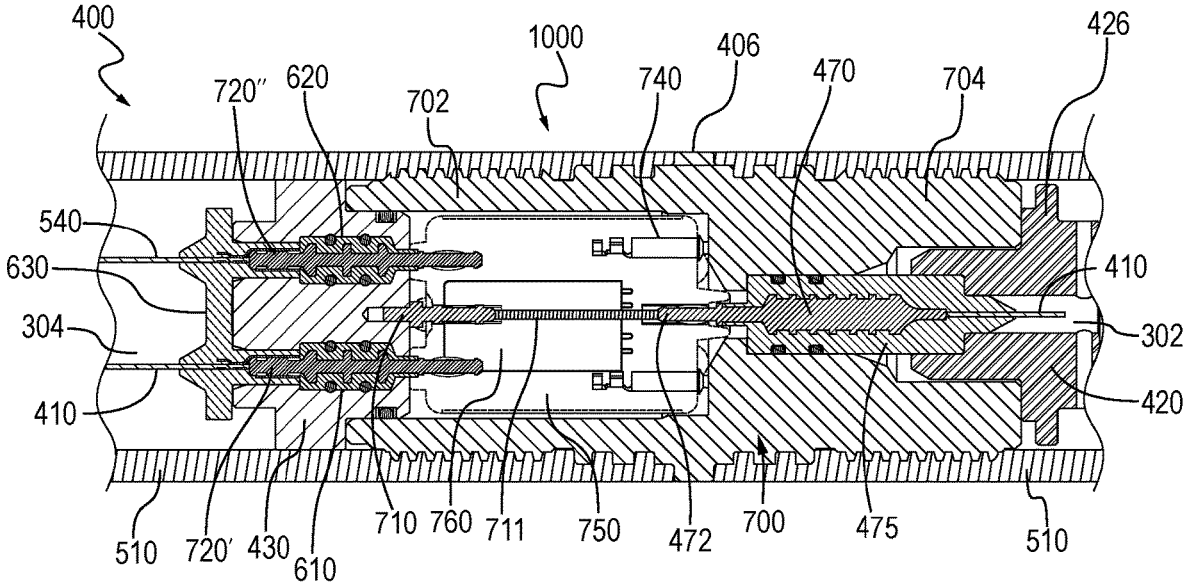
FIG. 10A is a side, cross-sectional view of an explosive initiation assembly of the present invention, in one embodiment. The explosive initiation assembly is threadedly connected at opposing ends to gun barrel housings, forming a portion of a perforating gun assembly. The explosive initiation assembly includes, among other components, a tandem sub, a switch housing and an addressable switch.

FIG. 10A is a side, cross-sectional view of an explosive initiation assembly 1000 of the present invention, in one embodiment. The explosive initiation assembly 1000 is threadedly connected at opposing ends to gun barrel housings 510, forming, for example, a part of the perforating gun assembly 200 of FIG. 2.

The explosive initiation assembly 1000 first includes a tandem sub 700. The tandem sub 700 represents a short tubular body having male threads at opposing ends 702, 704. Each opposing end 702, 704 is connected to a gun barrel housing 510. Intermediate the opposing ends 702, 704 is a shoulder 706. The gun barrels 510 are threaded onto the tandem sub 700 until they meet the shoulder 706. Additional details concerning the tandem sub 700 are described in the parent application in connection with FIG. 4.

Figure 12:
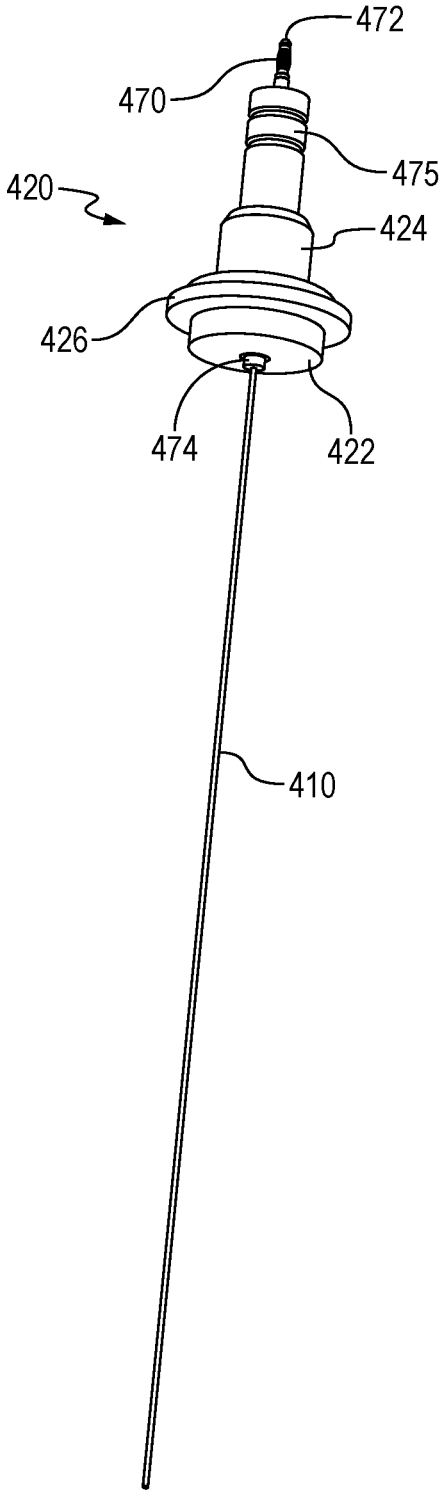
FIG. 12 is a perspective view of the top end plate of FIG. 11A. A contact pin and supporting bulkhead are seen extending up from the top end plate, while an electric line extends down. The view of FIG. 12 is the same as in FIG. 4A, but with the carrier tube and bottom end plate removed to show the electric line.
Figure 13:
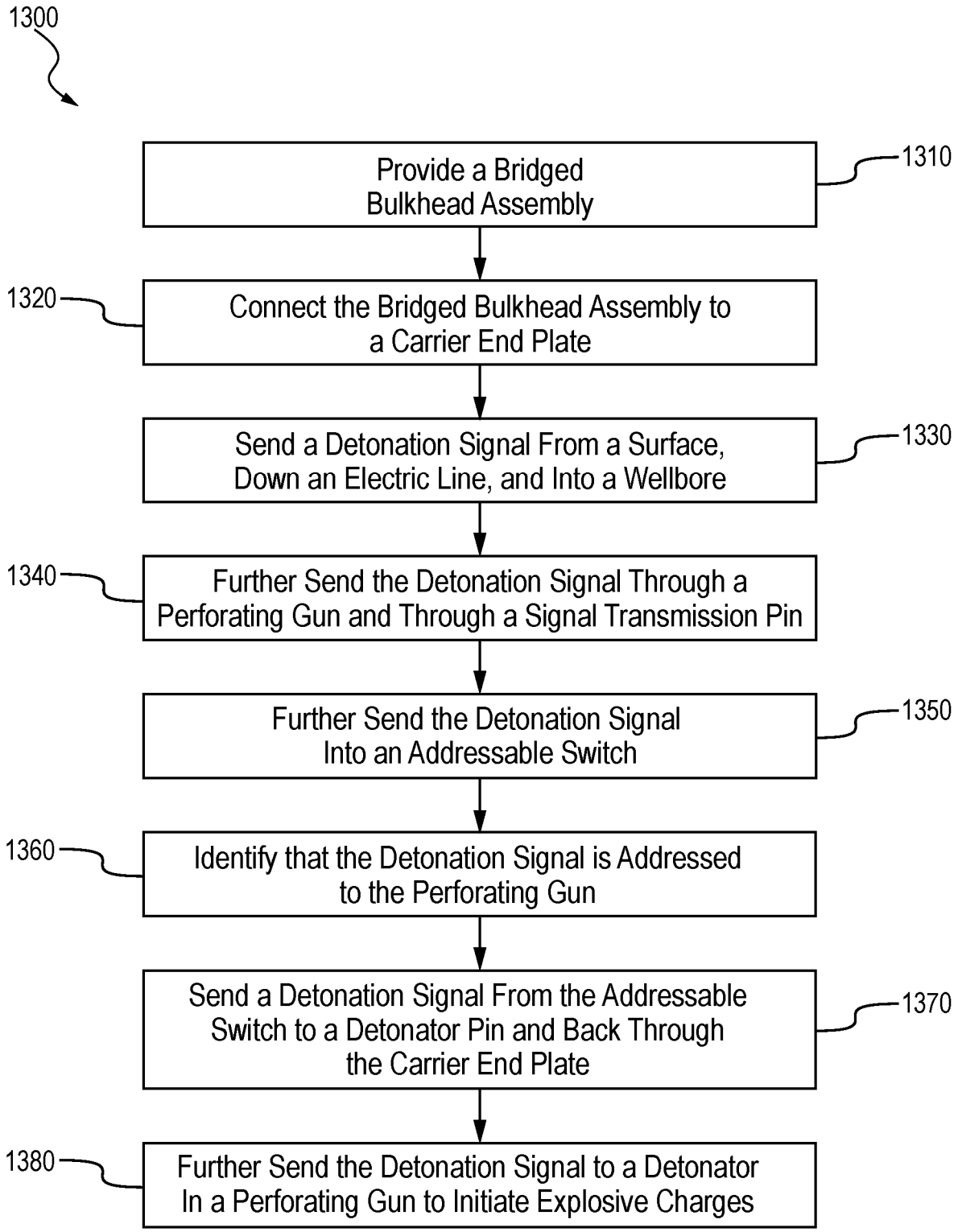
FIG. 13 presents a flow chart showing steps for a method of detonating explosive charges associated with a perforating gun, in one embodiment.

Residing within the tandem sub 700 is a switch housing 750. A perspective view of the switch housing 750 is shown in FIG. 12 of the parent application. The switch housing 750 holds an addressable switch 760. A perspective view of the addressable switch 760 is shown in FIG. 13 of the parent application.

The addressable switch 760 receives signals from the surface as sent by an operator, through signal transmission pin 720', and filters those signals to identify an activation signal. If an activation signal is identified, then a signal is separately sent for detonation of charges in an adjacent (typically upstream) perforating gun 210 through detonator pin 720". Note that neither the pin 710 nor the pin 720' is at any time in electrical communication with the detonator 229. Additional details of the switch housing 750 and the addressable switch 760 are also provided in the parent application in connection with FIGS. 12, 13, 16 and 17 and need not be repeated herein.

The tandem sub 700 and its switch housing 750 reside between the bottom end plate 430 and the top end plate 420. FIG. 11A is a perspective view of the top end plate 420, in one embodiment. The top end plate 420 has a proximal end 422 and a distal end 424. Intermediate the proximal 422 and distal 424 ends is the flange 426. As shown in FIG. 10, the downstream end of the tandem sub 700 shoulders out against the flange 426.

The proximal end 422 of the top end plate 420 comprises a threaded opening 421. The threaded opening 421 is configured to receive a bolt or pin (not shown) that radially fixes the top end plate 420 to the top of the carrier tube 300.

Figure 11A:
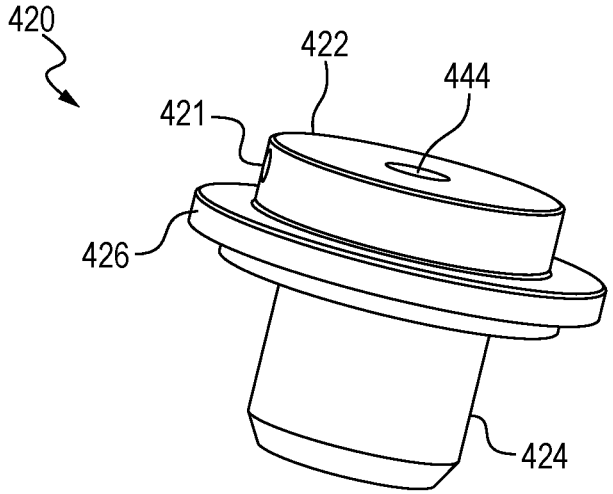
FIG. 11A is a perspective view of a top end plate that is part of a perforating gun assembly. The top end plate seats against the downstream end of the tandem sub of FIG. 10A.
Figure 11B:
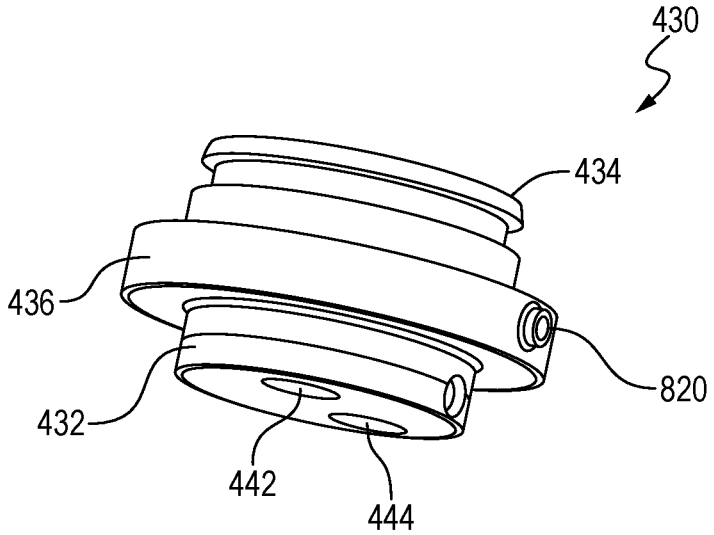
FIG. 11B is a perspective view of a bottom end plate that is part of the perforating gun assembly. The bottom end plate seats against the upstream end of the tandem sub of FIG. 10A, and receives the bridged bulkhead assembly of FIGS. 6A and 6B. Note that FIG. 5B shows the same end plate.

FIG. 11B is a perspective view of the bottom end plate 430 that is part of the perforating gun assembly 400, in one embodiment. The bottom end plate 430 seats against the upstream end of the tandem sub 700. As noted above, the bottom end plate 430 has a proximal end 432 and a distal end 434. Intermediate the proximal 432 and distal 434 ends is a flange 436.

At the proximal end 432 of the end plate 430 are two openings 442, 444. One of the openings 442 is dimensioned to receive the detonator pin 720" and the corresponding mini-bulkhead 620. The other opening 444 receives the signal transmission pin 720' and its own corresponding mini-bulkhead 610. As seen in FIG. 10A, the transmission pin 720' and the detonator pin 720" extend through the bottom end plate 430 and into the switch housing 750.

Flange members 436, 426 associated with the bottom end plate 430 and the top end plate 420, respectively, abut opposing ends of the tandem sub 700. Beneficially, the end plates 430, 420 mechanically seal the tandem sub 700, protecting the addressable switch 760 from wellbore fluids and debris generated during detonation of the charges 320.

Referring back to FIG. 10A, the explosive initiation assembly 1000 also includes a contact pin 470. The contact pin 470 resides within a non-conductive bulkhead 475. This is the same contact pin 470 and bulkhead 475 as are presented in FIG. 4A, discussed above. A first (or proximal) end of the contact pin 470 extends into the switch housing 750 while a second (or distal) end of the contact pin 470 extends into the top end plate 420. The contact pin 470 is used to transmit signals through the tandem sub 700 down to a next perforating gun, while the bulkhead 475 provides electrical insulation between the brass contact pin 470 and the surrounding metal tandem sub 700.

Figure 10B:
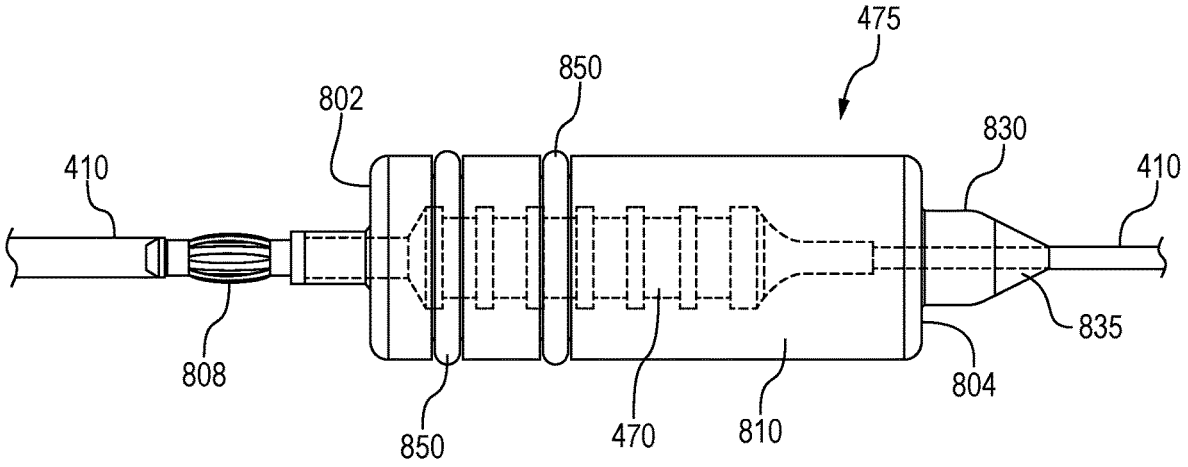
FIG. 10B is a side view of a bulkhead and contact pin as used in the explosive initiation assembly of FIG. 10A to transmit signals downstream.
Figure 10C:
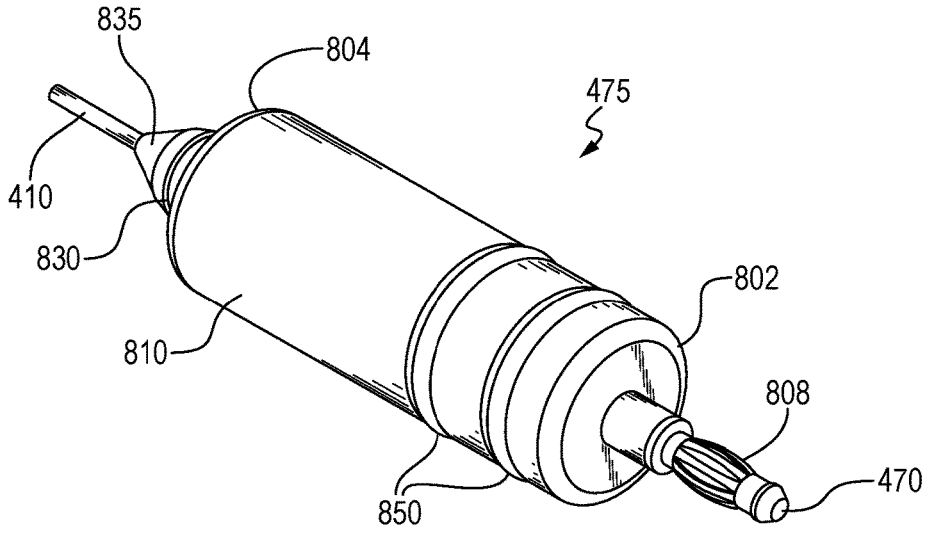
FIG. 10C is a perspective view of the contact pin and bulkhead of FIG. 10B.

FIG. 10B is an enlarged side view of the contact pin 470 and bulkhead 475 of FIG. 10A. FIG. 10C is a perspective view of the contact pin 470 and bulkhead 475. It can be seen that the bulkhead 475 defines a generally tubular body 810. The body 810 has an upstream end 802 and a downstream end 804. O-rings 850 are provided to ensure a seal relative to the surrounding tandem sub 700.

Of interest, the downstream end 804 includes an extended end piece 830. The end piece 830 offers a tip 835 that is over-molded onto the wire 410. The tip 835 secures the wire (or signal transmission line) 410, preventing the wire 410 from becoming separated from the pin 470 during run-in and operation. Preferably, the signal transmission line 410 is crimped before over-molding. An opposite end of the pin 470 defines a banana clip 808. The banana clip 808 resides within or at least extends well into the tandem sub 700.

Note that the bulkhead 475 and the contact pin 470 play no role in preventing a pressure wave from reaching the electronics or an upstream perforating gun after charges are detonated. That function is provided solely by the top end plate 420. Note also that neither the top end plate 420 nor the bottom end plate 430 is a so-called "tandem sub adapter." Indeed, the top end plate 420 and the bottom end plate 430 butt up against opposing ends 704, 702 of the tandem sub 700.

FIG. 12 is a perspective view of the top end plate 420. The contact pin 470 and supporting bulkhead 475 are seen extending up from the top end plate 420. The signal transmission line 410 is connected to the contact pin 470 at distal end 474 and extends down. Note that the view of FIG. 12 is the same as in FIG. 4A, but with the carrier tube 300 and bottom end plate 430 removed to show the signal transmission line 410.

Figure 2:
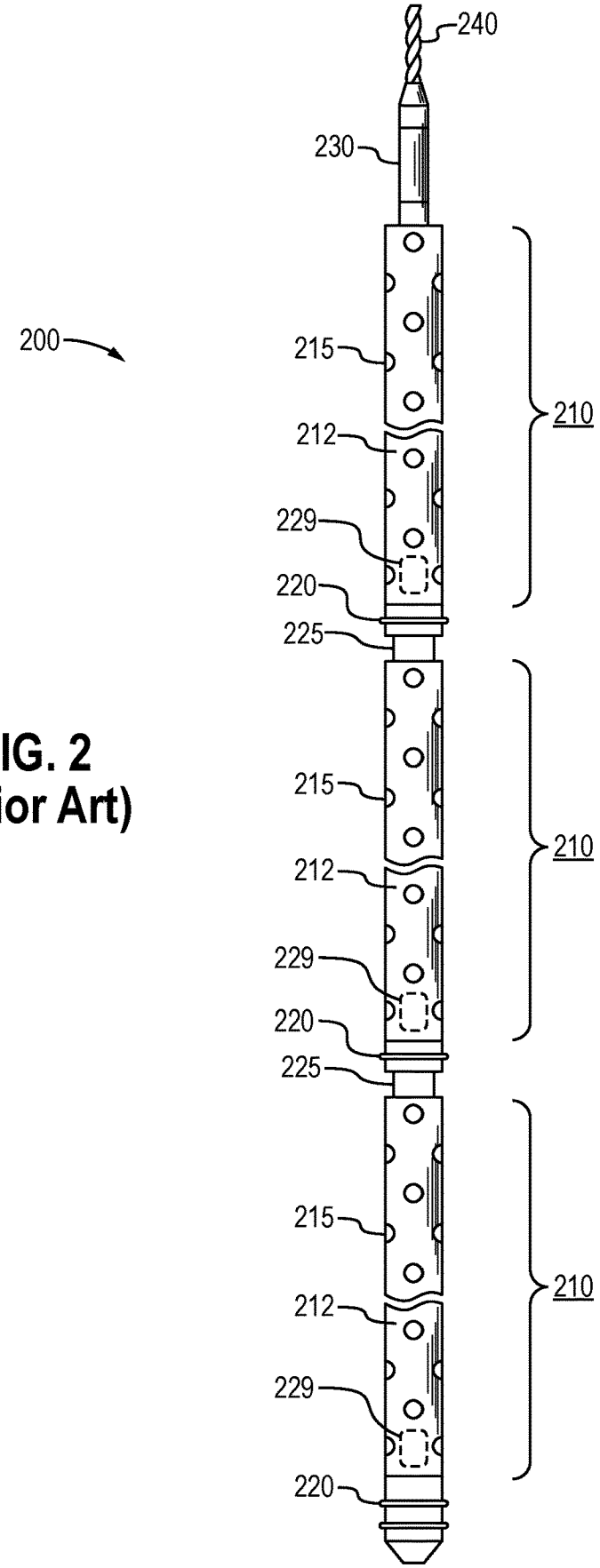
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing the threaded connections.

In operation, a detonation signal is sent from the surface 105 through the electric line 240. The signal reaches the perforating gun assembly 400 (including multiple perforating guns as shown in FIG. 2). Typically, a lowest perforating gun is designated for first explosive initiation. In that case, the signal passes along the internal transmission line 410 through each perforating gun 210 and is then passed along by the applicant's novel transmission pins 720', the novel addressable switches 760 in each tandem sub 700, and the contact pins 470 until the signal reaches a lowest tandem sub 700 and its addressable switch 760. According to the present disclosure, the addressable switch 760 then sends a detonation signal back up through the detonator pin 720", through wire 540, and to a detonator 229.

It is understood that the relative arrangement of the gun barrel 212, the bottom end plate 430, the tandem sub 700, the electronic switch housing 760 and all other components of the perforating gun assembly 400 and explosive initiation assembly 1000 may be "flipped." In this way, the tandem sub 700 is protected from a pressure wave upon detonation of charges in a downstream gun barrel 212.

As can be seen, a novel detonation system 1000 is provided. The detonation system provides protection for the electronics within the tandem sub 700 during detonation of an upstream (or adjacent) perforating gun. In one embodiment, the detonation system first includes the novel tandem sub. The tandem sub defines a generally tubular body having a first end and a second end. The first end and the second end each comprise male connectors. This allows the tandem sub to be threadedly connected, in series, to respective perforating guns. Thus, the first end is threadedly connected to a first perforating gun (or, more precisely, a female threaded end of a gun barrel), while the second end is threadedly connected to a second perforating gun (or, again, a female threaded end of an opposing gun barrel).

The first end of the tandem sub abuts a first (or bottom) end plate. Similarly, the second opposing end of the tandem sub abuts a second (or top) end plate. These may be in accordance with the bottom 430 and top 420 carrier end plates described above. An inner bore is formed between the first end and the second end of the tandem sub.

An electronic switch housing resides within the inner bore at the first end of the tandem sub. The switch housing holds an addressable switch configured to receive instruction signals from an operator at the surface.

In addition, a receptacle is formed within the inner bore of the tandem sub. The receptacle is dimensioned to closely receive a so-called "big bulkhead." The big bulkhead, shown at 475, comprises:

- a tubular body having a first end, a second end and a bore extending there between;
- an electrical contact pin 470 having a shaft extending through the bore of the bulkhead body and having an upstream end and a downstream end, wherein the shaft resides within the bore, and wherein the electrical contact pin transmits current from the upstream end to the downstream end 830 of the bulkhead; and
- a contact head 472 located at the upstream end of the electrical contact pin outside of the bulkhead body and extending into the switch housing.

The electrical contact pin and its contact head are fabricated substantially from a conductive material such as brass. Of interest, the bulkhead is over-molded over a wire that exits the downstream end of the contact pin.

The bottom end plate comprises a bore that defines a first opening and a second opening. A signal transmission pin 720' extends through the first opening and into the carrier tube. Instruction signals are sent through the signal transmission pin 720'. A separate detonator pin 720" extends through the second opening and into the carrier tube. The detonator pin 720" is in electrical communication with a detonator residing within the first perforating gun. The detonator is configured to receive activation signals from the addressable switch, and ignite an explosive material within a detonating cord. The explosive material travels to shaped charges associated with the first perforating gun to ignite the charges.

All electrical connections for the detonation system may be made at the gun building facility, that is, except for the wires being connected to the detonator and the addressable switch. The end plate on the gun barrel (or gun carrier) is removed, and the pre-wired electronic switch assembly (that is, the switch housing 750 and encapsulated switch 760) is installed. Beneficially, the bulkheads for the two electrical signal pins 720', 720" associated with the bottom end plate 430 are pre-installed over bulkheads 610, 620 associated with the pins 720', 720" together as part of the novel bridged bulkhead 600.

The bottom end plate 430 is slid against the upstream end 402 of the tandem sub 700. The pre-wired switch assembly can be tested at the gun building facility to reduce the chance of a mis-wired connection.

As an alternative, the addressable switch can be installed on the bottom endplate in the shop and sent out. This leaves only the detonator to install.

Note again that the tandem sub 700 need not have a side port. Removing the port from the sub 700 eliminates problems associated with known ports such as gun-flooding due to a missing o-ring and pinched wires under the plug port. The detonator is installed later in the field to comply with DOT and ATF regulations and API-RP67 recommendations.

In addition to the explosive initiation assembly 1000 discussed above, a method of detonating explosive charges associated with a perforating gun is presented herein. The perforating gun utilizes an addressable switch that transmits a detonation signal to a detonator in an adjacent perforating gun. The detonator, in turn, ignites an explosive material, creating an explosion that is passed through a detonating cord. The detonating cord then ignites shaped charges along the perforating gun.

FIG. 13 represents a flow chart showing steps for a method 1300 of detonating explosive charges associated with a perforating gun. In one aspect, the method 1300 first comprises providing a bridged bulkhead assembly. This is provided in Box 1310 of FIG. 13A. As discussed above, the bridged bulkhead assembly comprises:

- a first bulkhead;
- a signal transmission pin residing within the first bulkhead;
- a second bulkhead;
- a detonator pin residing within the second bulkhead; and
- a bridge fixedly connecting and spacing apart the first bulkhead with the second bulkhead.

In a preferred embodiment, the first bulkhead comprises a body having a first end, and a second end opposite the first end. Similarly, the second bulkhead comprises a body having a first end, and a second end opposite the first end. Each of the first bulkhead and the second bulkhead is fabricated from an electrically non-conductive material. For purposes of service in a perforating gun assembly, each of the first and second bulkheads is considered a "mini-bulkhead."

The bridge comprises a body having first and second through-openings. The first through-opening of the bridge fixedly receives the signal transmission pin, while the second through-opening of the bridge fixedly receives the detonator pin.

The method 1300 also includes connecting the bridged bulkhead assembly to a carrier end plate. This is shown in Box 1320. In this step, the first bulkhead (and signal transmission pin) extends into a first opening of the carrier end plate while the second bulkhead (and detonator pin) extends into a second opening of the carrier end plate. The carrier end plate may be configured in accordance with the carrier end plate 430 described above, with banana clips 618, 628 protruding downstream from the end plate 430 to be placed into a tandem sub 700.

The method 1300 further comprises sending a detonation signal (or IE signal) from a surface, down an electric line, and into a wellbore. This is seen in Box 1330.

The method 1300 also includes further sending the detonation signal through a perforating gun and through the signal transmission pin 720'. This is provided in Box 1340.

The signal transmission line 410 is connected to the signal transmission pin 720' at the first end of the first bulkhead 610. At the same time, a detonator wire 540 is connected to the detonator pin 720" at the first end of the second bulkhead 620. This may be in accordance with the bulkhead assembly 600 of FIGS. 6A and 6B, which uses over-molding to protect the wire connections.

The second end of the signal transmission pin 720' extends from the second end of the first bulkhead 610 and down to the banana clip 618. The banana clip 618 of the signal transmission pin 720' is in electrical communication with an addressable switch 760. Similarly, the second end of the detonator pin 720" extends from the second end of the second bulkhead 620 and also comprises a banana clip 628. Note that the banana clip 628 of the detonator pin 720" is never in electrical communication with the signal transmission line 410 or the banana clip 618 of the signal transmission pin 720'.

The method 1300 includes further sending the detonation signal into the addressable switch, wherein the addressable switch determines whether the detonation signal is addressed to the specific perforating gun. The addressable switch resides within a tandem sub below the perforating gun. This is offered in Box 1350.

The method 1300 additionally comprises identifying that the detonation signal is addressed to the perforating gun. This is shown in Box 1360 of FIG. 13B. In response, the addressable switch sends a detonation signal to the detonator pin 720" and back through the carrier end plate 430.

The method 1300 then includes sending the detonation signal to a detonator to initiate explosive charges residing within the perforating gun. This is seen in Box 1370. Note that the carrier end plate isolates the addressable switch from wellbore fluids and a pressure wave generated in response to the detonation of the explosive charges. In other words, an upstream perforating gun may be activated without damaging the electronic switch assembly in the tandem sub 700. The switch assembly 760 may be reused for another perforation operation. Similarly, the contact pin 470, the big bulkhead 475, and the tandem sub 700 itself are protected for later re-use.

In the method 1300, the addressable switch 760 is configured to monitor instruction signals received through the signal line 410. Stated another way, the addressable switches filter instruction signals from the operator at the surface. When an addressable switch receives a signal associated with its tandem sub and perforating gun, the switch 660 is armed and a window of time is opened (typically about 30 seconds) in which to send a detonation signal from the surface. Upon receiving confirmation, the addressable switch will send a detonation signal through the detonation pin and back up to a detonator through line 540. The detonator, in turn, ignites the explosive material that passes through the detonating cord and on to the charges along the carrier tube.

If the instruction signal is not recognized as a detonation signal for that tandem sub 700, the signal is sent on through the contact head 472 residing inside of the switch housing 750 associated with the contact pin 470 From there, the signal is sent through the contact pin 470, through the top end plate 420, and on to a next perforating gun and a next bridged bulkhead.

Before the detonation of the upstream perforating gun, the electronic switch can feed current down to a next perforating gun (or to a bulkhead associated with a next perforating gun), depending on the instruction.

As another way of expressing the sequence, an IE signal enters the perforating gun assembly via a big bulkhead 475, passes down the next downstream carrier tube via signal transmission line 410, goes through the transmission pin 710' and into the addressable switch 760. If a detonation signal is present, a detonation signal is sent back upstream through the detonator pin 720" and into the detonator (shown at 229 in the parent application). Otherwise, it can continue downstream from the addressable switch 760, through signal wire 711, through a next contact pin 470, down wire (or next portion of signal transmission line) 410, and to the next downstream perforating gun. The process then repeats.

After production casing has been perforated at a first level, the operator may pull the perforating gun assembly 200 up the wellbore 100. The operator then sends a next detonation signal down through the electric line 240, through the signal transmission line 410 of the perforating gun assembly 200 and the various tandem subs 700 and contact pins 470, and down to a next-lowest tandem sub 700. The detonation signal is recognized by the addressable switch 760 in the next-lowest tandem sub 700 and a detonation signal is sent through a detonator pin 720" and wire 540 to a next associated detonator 229. The detonation charge in the detonator 229 ignites the explosive material in the detonator cord and the charges 320 of the next upstream gun barrel 212.

The pressure wave from the charges acts against the bottom end plate 430, protecting the tandem sub 700 and housed electronics 760 from damage from the upstream perforating gun 210. Similarly, a top end plate 420 protects the electronics in a further upstream gun from the pressure wave.

The disclosed embodiments provide methods and systems for preventing electronics located inside a switch sub from being damaged by detonation of an adjacent perforating gun. It should be understood that this description is not intended to limit the invention; on the contrary, the exemplary embodiments are intended to cover alternatives, modifications, and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Further, variations of the detonation system and of methods for using the detonation system within a wellbore may fall within the spirit of the claims, below. It will be appreciated that the inventions are susceptible to other modifications, variations, and changes without departing from the spirit thereof.

I claim:

1. A bulkhead for transmitting detonation signals, comprising:

an elongated tubular body having a first end, a second end opposite the first end, and a bore extending from the first end to the second end;

a signal pin residing within the bore of the bulkhead, the signal pin also having a first end, and a second end opposite the first end and configured to transmit electrical signals from the first end to the second end;

an electrically conductive wire connected to the second end of the signal pin within the bulkhead; and an end piece integral to and extending from the second end of the bulkhead, closely and frictionally holding the conductive wire in place;

wherein the first end of the signal pin resides proximate the first end of the tubular body to receive the electrical signals, while the second end of the signal pin resides proximate the second end piece of the tubular body to deliver the electrical signals.

2. The bulkhead of claim 1, wherein the second end of the signal pin extends into the end piece of the body.

3. The bulkhead of claim 2, wherein the first end of the signal pin comprises a banana clip.

4. The bulkhead of claim 3, wherein the banana clip extends out from the first end of the bulkhead.

5. The bulkhead of claim 2, wherein the signal pin comprises a plurality of grooves; and the tubular body has a bore that comprises a profile for mating with the plurality of grooves for increasing shear strength of the bulkhead.

6. The bulkhead of claim 5, wherein the signal pin further comprises a frusto-conical portion proximate the first end of the signal pin shaft that fits into a mating conical profile of the bore.

7. The bulkhead of claim 5, wherein:

the tubular body resides within a tandem sub, and is fabricated from a non-conductive material; and the electrical contact pin is fabricated substantially from brass.

8. The bulkhead of claim 7, wherein the plurality of grooves comprises at least three grooves equi-distantly spaced along the signal pin.

* * * * *